US005865087A

United States Patent [19]

Olson

[11] Patent Number: 5,865,087

[45] Date of Patent: Feb. 2, 1999

[54] ROTARY VARIABLE DISPLACEMENT FLUID POWER DEVICE

[76] Inventor: Howard A. Olson, 300-18 Court, Plum City, Wis. 54761

[21] Appl. No.: 733,728

[22] Filed: Oct. 18, 1996

[51] Int. Cl.[6] ..... F01B 1/06

[52] U.S. Cl. ..... 91/497; 91/491; 417/219; 417/221; 417/273

[58] Field of Search ..... 417/219, 221, 417/273; 91/497, 491

[56] References Cited

U.S. PATENT DOCUMENTS

| | | | |
|---|---|---|---|
| 2,205,913 | 6/1940 | Stacy | 103/161 |
| 2,608,934 | 9/1952 | Ferris | 103/161 |
| 2,674,195 | 4/1954 | Aluja | 103/161 |
| 3,067,728 | 12/1962 | Bordini | 121/120 |
| 3,242,870 | 3/1966 | Bush | 103/176 |
| 3,369,457 | 2/1968 | Guinot | 91/16 |
| 3,403,599 | 10/1968 | Guinot | 91/205 |
| 3,758,899 | 9/1973 | Freeman | 91/475 |
| 4,404,896 | 9/1983 | Allart et al. | 91/491 |
| 4,413,486 | 11/1983 | Irwin | 60/39.63 |
| 4,612,882 | 9/1986 | Bonfilio | 123/44 R |
| 4,625,683 | 12/1986 | Bonfilio | 123/44 R |
| 4,777,866 | 10/1988 | Tan | 91/488 |
| 5,752,427 | 5/1998 | Letner | 91/497 |

*Primary Examiner*—Timothy Thorpe
*Assistant Examiner*—Ehud Gartenberg

[57] ABSTRACT

A cooperating rotor device having a first rotor supported for rotation about a first rotation axis (R1) and a second rotor supported for rotation about a second rotation axis (R2). A cylinder rotor (32), supporting a plurality of radially aligned cylinders (33) spaced apart and supported for collective rotation about one rotation axis (R1). Each cylinder (33) having a piston (39) slidable within. A piston rotor (61) has a number of piston rollers (64) corresponding to the number of cylinders (33), each radially supporting a piston (39), with each piston roller (64) independently rotatably supported and all piston rollers (64) collectively rotatable about the other rotation axis (R2). Members including the piston rollers (64), pistons (39), cylinders (33), and cylinder ports (34), all sharing a common plane of rotation about diametrically opposed non-rotating valve ports (74*a*) and (74*b*). In embodiments providing controlled variable displacement, a arm (20) or paired housing covers (53), independently and rotatably support one of the rotors (61) or (32) and is rotatably attached to and supported by a linear actuator (90) by a linkage pin (92) pivotably supporting arm (20) or housing covers (53). Cooperative rotor coupling is primarily accomplished by contact between coupling guides (35) furnished by the cylinder rotor (32) and the piston rollers (64) radially supporting each piston (39) furnished by the piston rotor (61). A share of the cooperative rotor coupling function can be, and normally is, also performed by rolling contact between each piston roller (64) and each piston (39).

11 Claims, 10 Drawing Sheets

ROTARY VARIABLE DISPLACEMENT FLUID POWER DEVICE

BACKGROUND

1. Field of Invention

Figure 1:
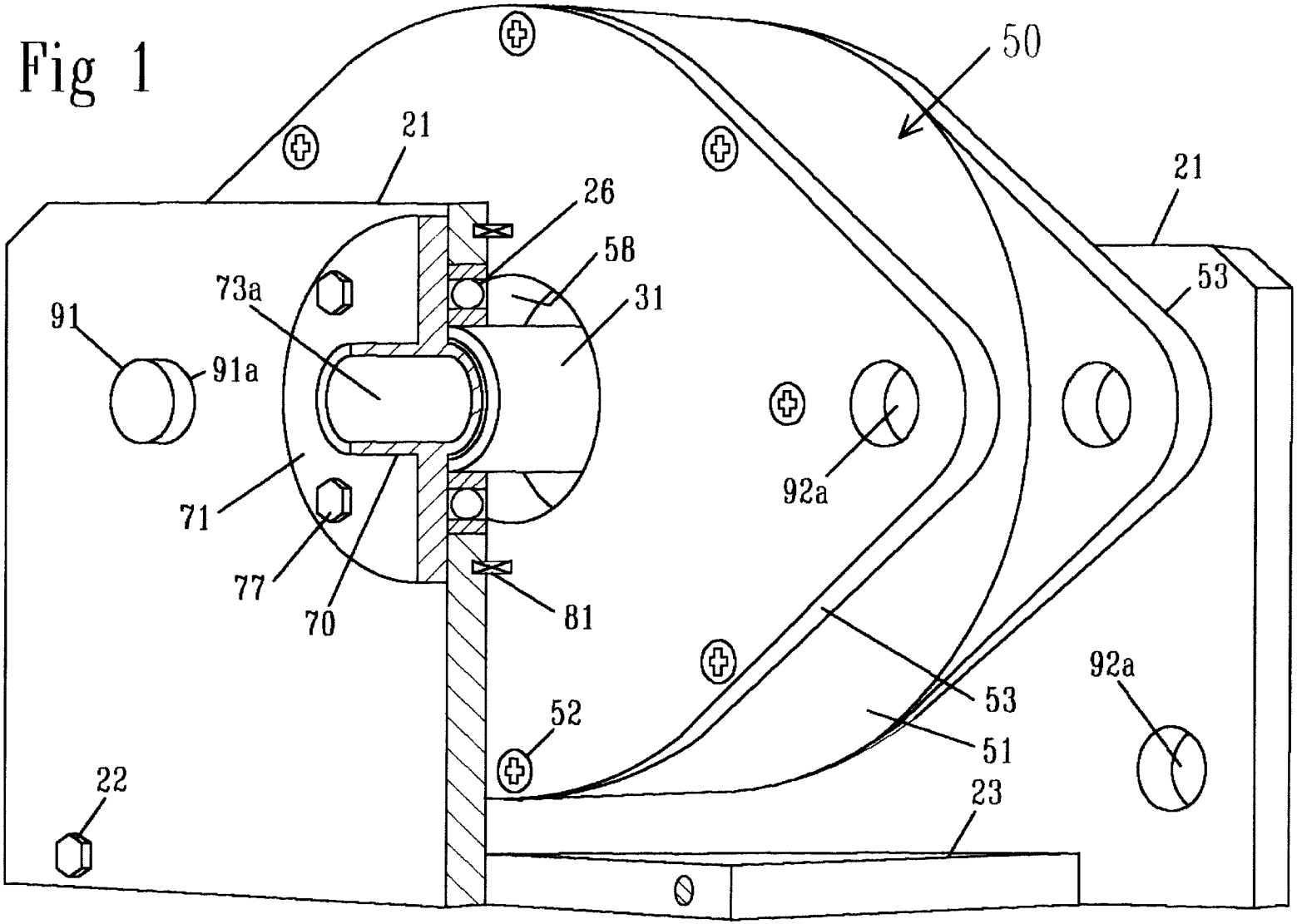

This invention relates to fluid power devices commonly known as pumps, compressors, and fluid motors.

2. General Description of Prior Art

Persons involved in the design and production of many types of powered equipment, both portable and stationary, are becoming increasingly aware of the advantages of variable displacement in regard to control of fluid power systems. Various combinations of fluid power devices generally involving some combination of pump and fluid motor devices where one or more such devices is capable of varible displacement can provide a exceptionally versatile means of rotary power transmission popularly known as hydrostatic transmissions. The relatively high initial cost, the reliance on oil as a working fluid, and some doubts in regard to the reliability and maintenance of such transmissions has precluded their more widespread use however.

Variable displacement pumps and fluid motor devices produced to date tend to be highly dependent on lubrication. In as much as it is difficult or impossible in most prior art to segregate a suitable lubricant from the working fluid, it is not surprising that the working fluid itself is commonly relied upon to provide the necessary lubrication. The use of a petroleum based oil, often of a very specific type and weight, is therefore mandatory in most variable displacement fluid power devices commonly available.

While oils have other properties making them an excellent choice as a working fluid, oils also have disadvantages. Oils tend to be messy and can pose a risk of contamination, pollution, or pose a unacceptable safety hazard. Fluids of other types, such as water, slurries, fluid mixtures, or gases such as ambient air; fluids which may be readily available or required by a particular application cannot be used. Therefore some inherent advantages of variable displacement, such as volumetric flow control of liquids, process liquids for example, cannot be properly realized or exploited.

It is also likely that new applications not presently contemplated or seriously explored for lack of a suitable mechanism will be found for variable displacement devices capable of efficiently using fluids other than oil as working fluids. Compressors for example, can be made more efficient if capable of variable displacement as less adiabatic heat tends to be generated and more of the adiabatic heat which is produced can be usefully recovered when compressed air is provided as used rather than provided and stored. (Most compressors pump to pressures at least twenty-five percent higher than the working pressure of the compressed air system they serve and adiabatic heat generated by compression is lost or intentionally discarded for storage purposes).

Few prior art devices capable of variable displacement can be operated for more than a few minutes if a suitable working fluid is not continuously flowing through the device. In some devices, the working fluid must not only be immediately available on start up to a pump or motor device of this type whether simply rotating or working, but must also be pressurized by a external charging pump. Failure of the charging pump or charging system can result in immediate and catastophic failure and the additional pump and fluid system adds significantly to the cost and complication of the system overall.

Other disadvantages of prior art devices capable of variable displacement generally, and regardless of type, include a high cost to produce and maintain and a dependence on very clean, continuously filtered working fluids, regardless of the fluid used.

It is common in prior art devices generally regarded as rotary devices to provide a piston surface area considerably larger than the maximum piston stroke. In a fluid power device where volumetric displacement is regulated by changing the effective length of the piston stroke, (or stroke equivalent), a device having a short maximum stroke is at a considerable disadvantage. Even relatively minor internal fluid leakage or slip can significantly affect or even nullify performance at low displacement settings, particularly as fluid system pressure is increased. Accurate control of the displaced fluid flow volume in such devices can therefore be difficult to achieve and maintain.

Description of Prior Art

Heretofore several prior art devices have been proposed wherein both members of a plurality of mating piston and cylinder sets are cooperatively rotated. Most such devices rely on some type of forceful rubbing or sliding contact between members to maintain radial alignment between the members of each piston and cylinder set as cooperative rotation occurs. Forceful sliding contact between a member providing radial support for one or the other member of each piston and cylinder set is also commonly relied upon as a mechanism for ensuring cooperative rotation of the piston and cylinders members and thereby ensuring constant radial alignment of the piston and cylinder members as the members are cooperative rotated.

Irrespective of whether the piston or cylinder members of each piston and cylinder set of a given prior art device are individually and slidingly relocated as cooperative rotation occurs during operation, the members being transversely displaced by sliding tend to be relatively massive and the sliding transverse relocation must reverse direction twice each revolution of the piston and cylinder members.

There would seem to be few if any advantages gained by substitution of a lateral or transverse reciprocating inertia for reciprocating inertia along the line of piston displacement, particularly when an additional friction load as a result of forceful rubbing contact with the member radially supporting the transversely reciprocating member is considered.

In addition, and depending on the relative location of the sliding contact surfaces supporting the transversely reciprocating members, centrifugal forces as well as the reactive forces resulting from the fluid pressures developed by the device can add significantly in regard to the reciprocating sliding friction load as operating speeds are increased.

If the transversely reciprocating members are supported in a manner which takes advantage of the centrifugal forces generated to ease the sliding friction load, the effectiveness of the coupling mechanism relied on to ensure cooperative rotation of the pistons and cylinders as required to maintain radial alignment between mating pistons and cylinders during operation is proportionally diminished as operating speeds increase.

Another common disadvantage of prior art using radially aligned pistons is lack of dynamic balance. The angular spacing between members required to reciprocate transversely must change constantly during operation thereby imposing the combined radial load of the transversely displaced members asymmetrically upon a supporting rotating member, a medial member or cooperatively rotated housing, for example. The imbalance is readily apparent using a suitable end view of a prior art device of the general type noted and comparing the angular spacing between various piston and cylinder members in regard to the rotation axis of the member radially supporting each during operation.

Objects and Advantages of the Present Invention

Accordingly it is an object and advantage of the present invention to provide a fluid power device suitable for use as a pump, compressor, fluid motor, or fluid metering device capable of accurate variable displacement control while readily adaptable to the use of working fluids of disparate properties, such as oil, water, and air.

It is a further object and advantage of the present invention that most common fluids to include gaseous fluids can be accomodated over a wide range of operating speeds without vibration or pulsing, with minimal risk of cavitation and minimal headspace at maximum displacement. Friction loads are significantly reduced by replacing sliding friction with rolling friction and the rolling friction load tends to be less affected by operating speeds and fluid system pressures while significantly less dependent on lubrication.

It is a further object and advantage of the present invention that reciprocating inertia is essentially eliminated and dynamic balance can be provided at all operating speeds.

Other objects and advantages of the present invention include: In a variable displacement device according to the present invention the working fluid flow direction, rate, and pressure can be continuously adjusted whether operating or stopped from maximum to zero to maximum as desired by the device operator. When operated at constant speed, the rate and direction of working fluid flow can be rapidly changed or consistently maintained at selected rates indefinitely, to include zero displacement or null mode. Operation in null mode essentially involves only rotation without load and is virtually frictionless, and because the angular inertia of a device operating in null mode is identical to one operating in working mode, the change from null mode to working mode in either direction of working fluid flow, or vice versa, can be made very rapidly.

It is a further object and advantage of the present invention that a device according to the present invention can comprise only a few simple shapes, each easily produced with common machine tools. The simplicity of member shapes permitting fabrication of the relatively few members required from a wide range of materials to include plastics, cast metals or metal shapes, high alloy steels, ceramics, and others. Devices according to the present invention therefore tend to be reliable and are easily maintained and repaired. Few precise fabrication or repair procedures are required even in special application devices and these procedures generally involve piston and bearing fits and the like; procedures well defined and understood by most mechanics even if relatively unskilled in the production or maintenance of fluid devices generally.

DRAWING FIGURES

FIG. 1. A perspective view of a preferred embodiment of the present invention partially sectioned as indicated.

Figure 2:
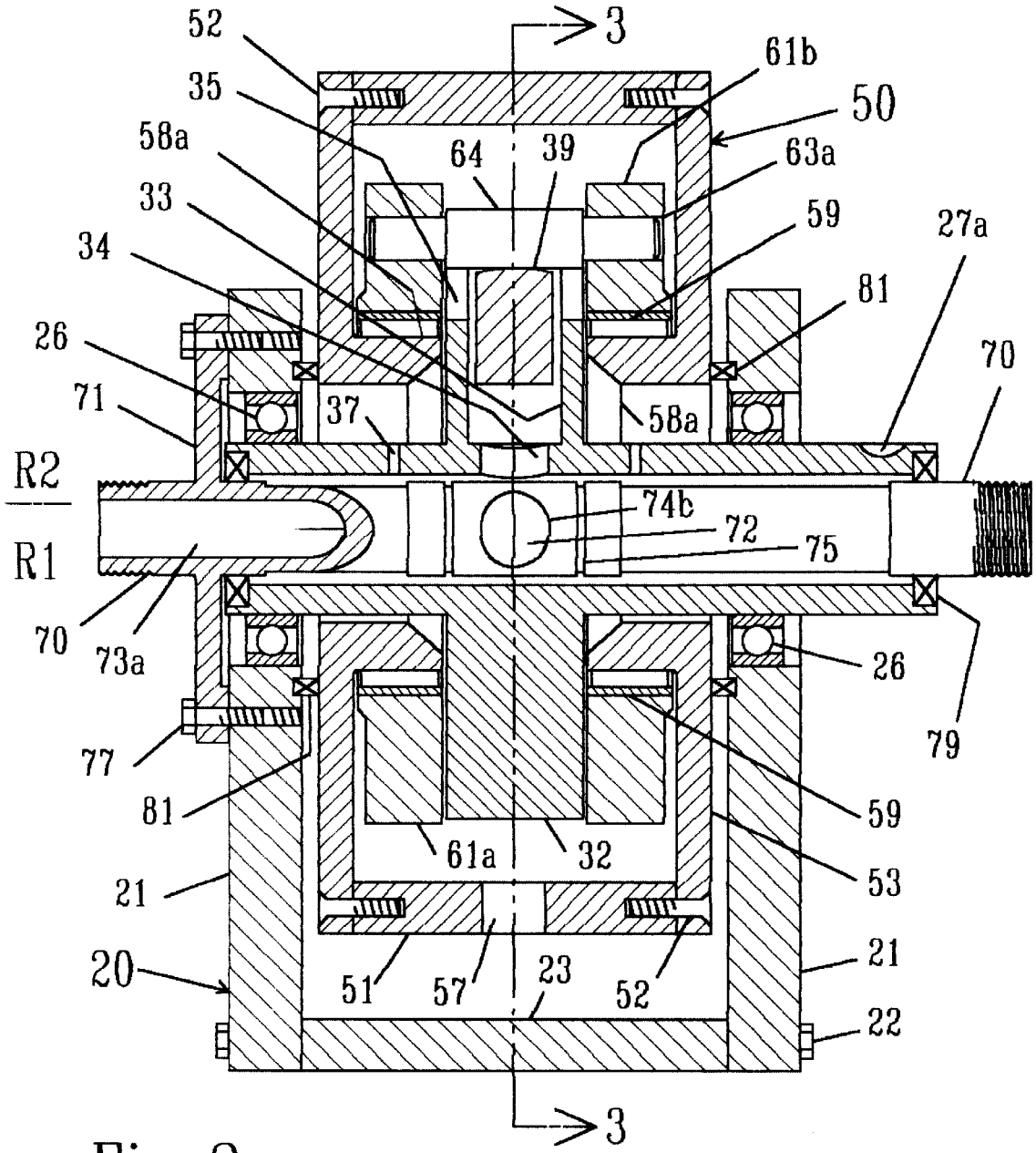

FIG. 2. A side view of the embodiment of FIG. 1, and, with exception for the valve, plane sectioned on the vertical midline.

Figure 3:
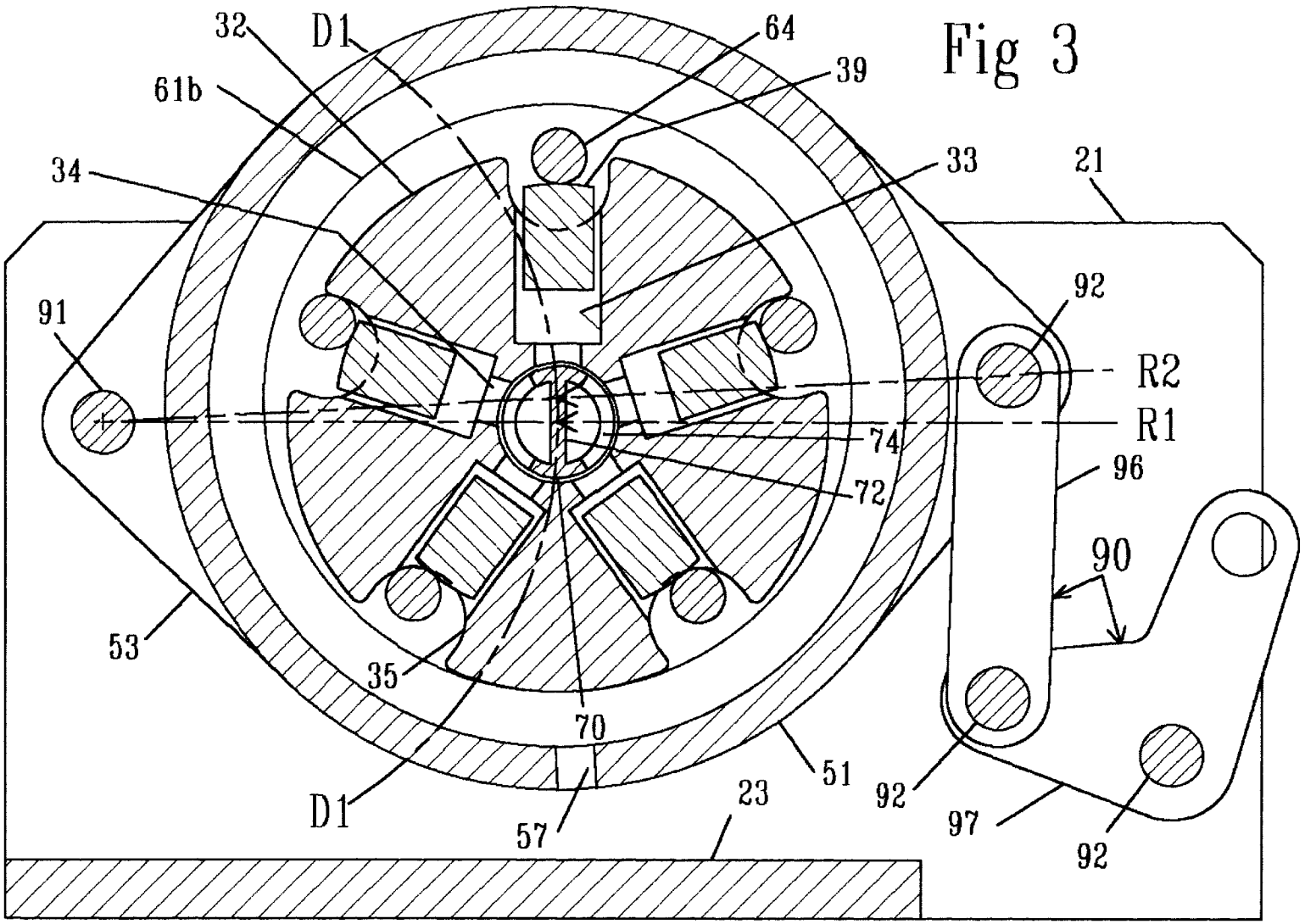

FIG. 3. An end view of the embodiment of FIG. 1, plane sectioned on the vertical midline as indicated by line 3—3 of FIG. 2. The device is shown in working mode and set to one of the two positions available providing maximum displacement.

Figure 3A:
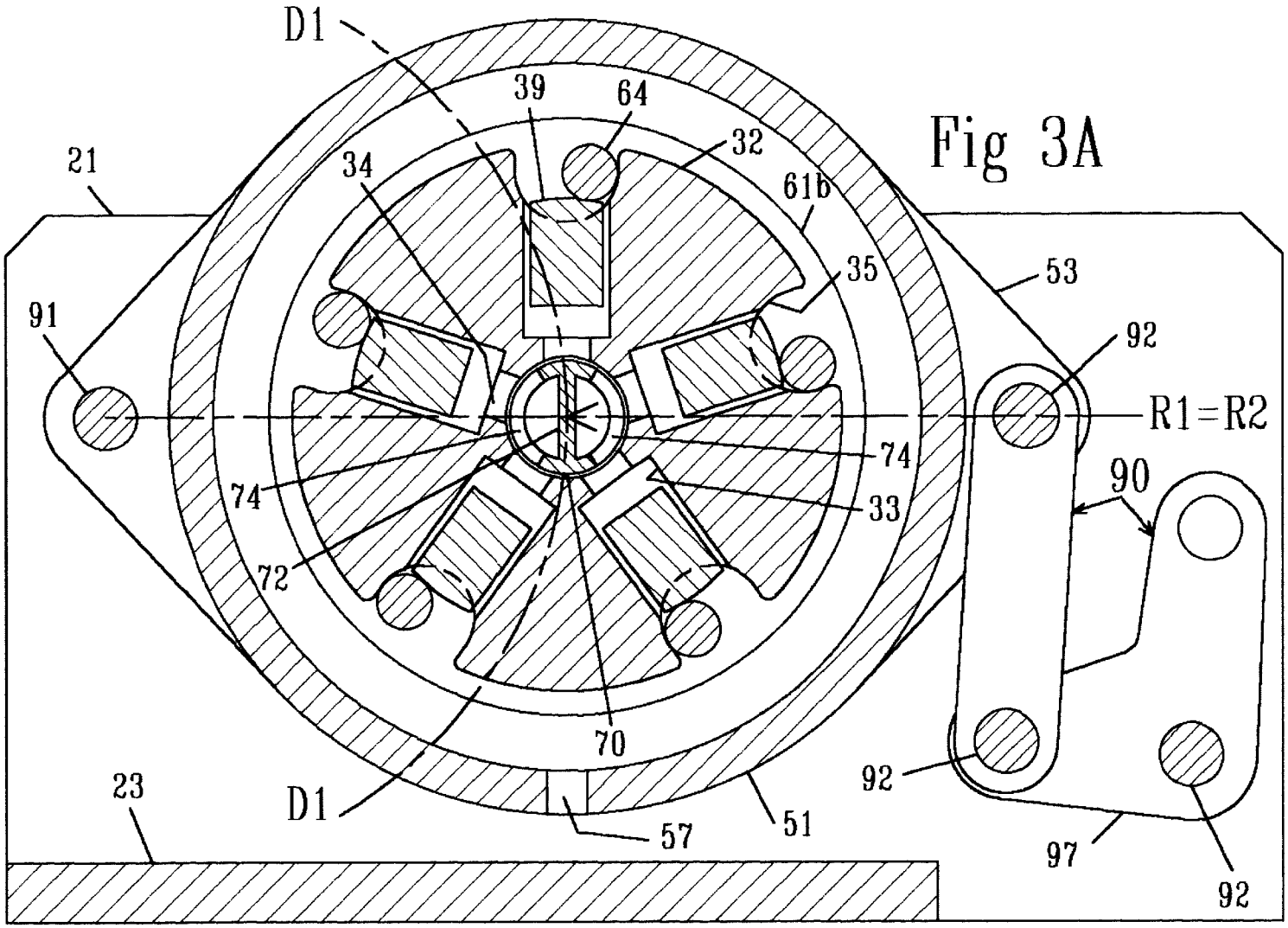

FIG. 3A. A view identical to that of FIG. 3. The device is shown set to the zero displacement position or null mode.

Figure 4:
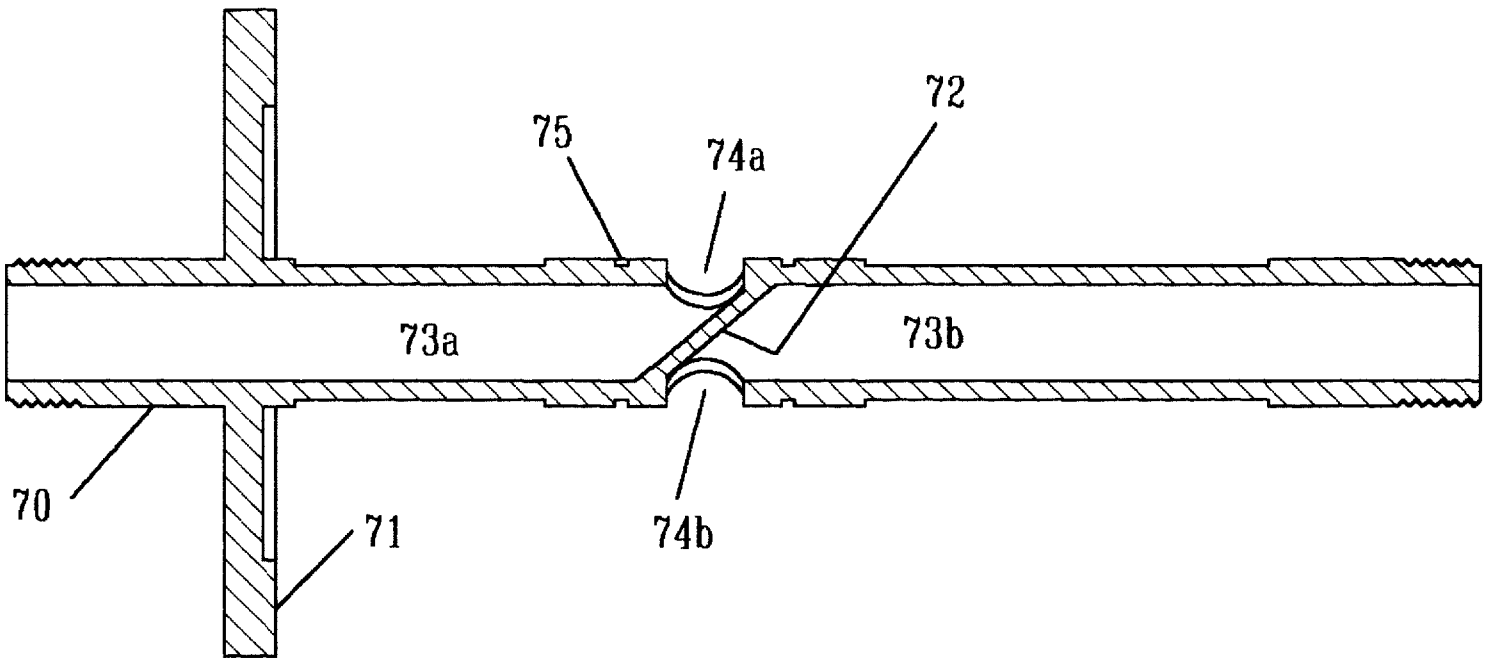

FIG. 4. A top view of a preferred valve embodiment suitable for use with the device embodiment of FIGS. 1, 2, and 3, sectioned on the horizontal midline.

Figure 5:
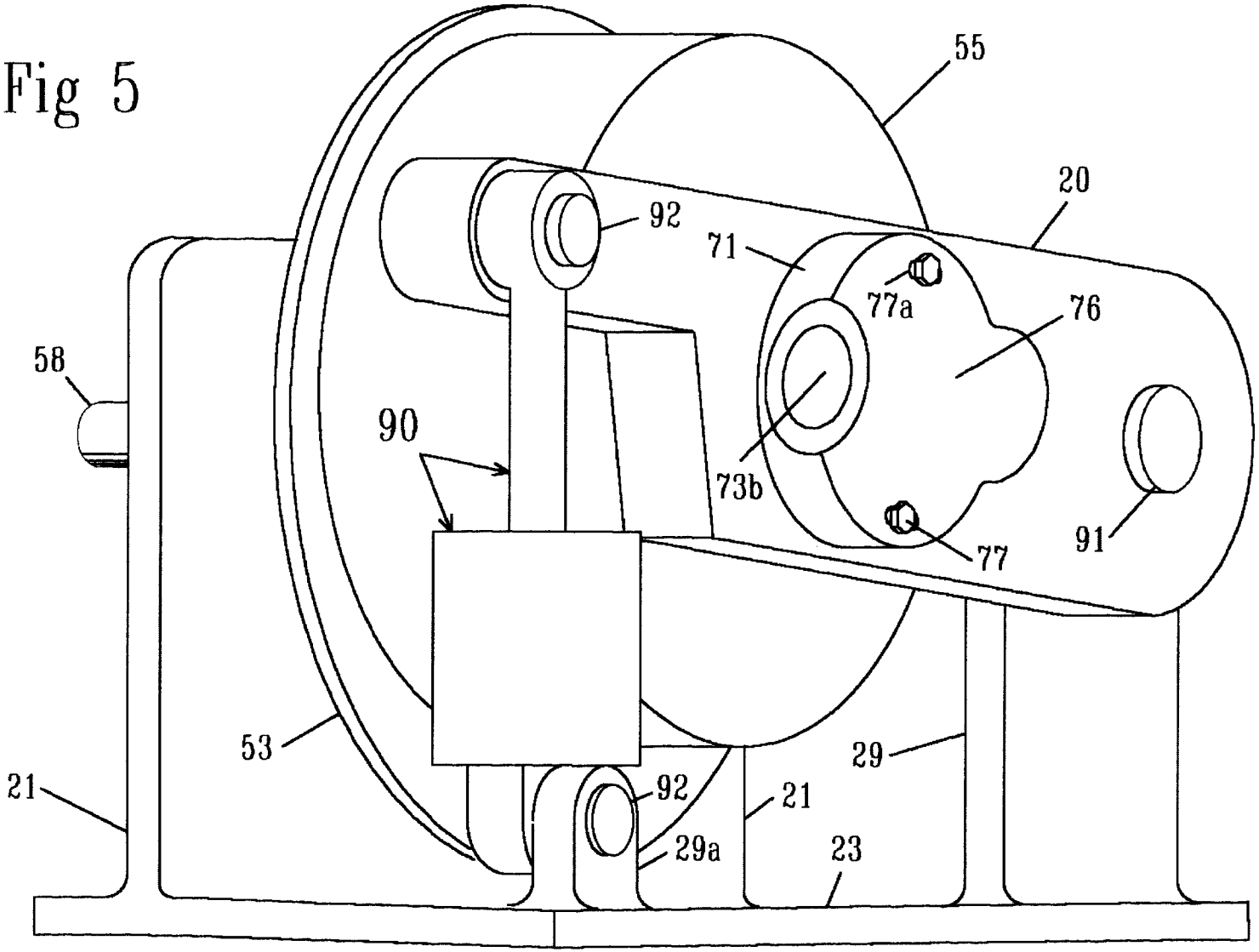

FIG. 5. A perspective view of a second preferred embodiment.

Figure 6:
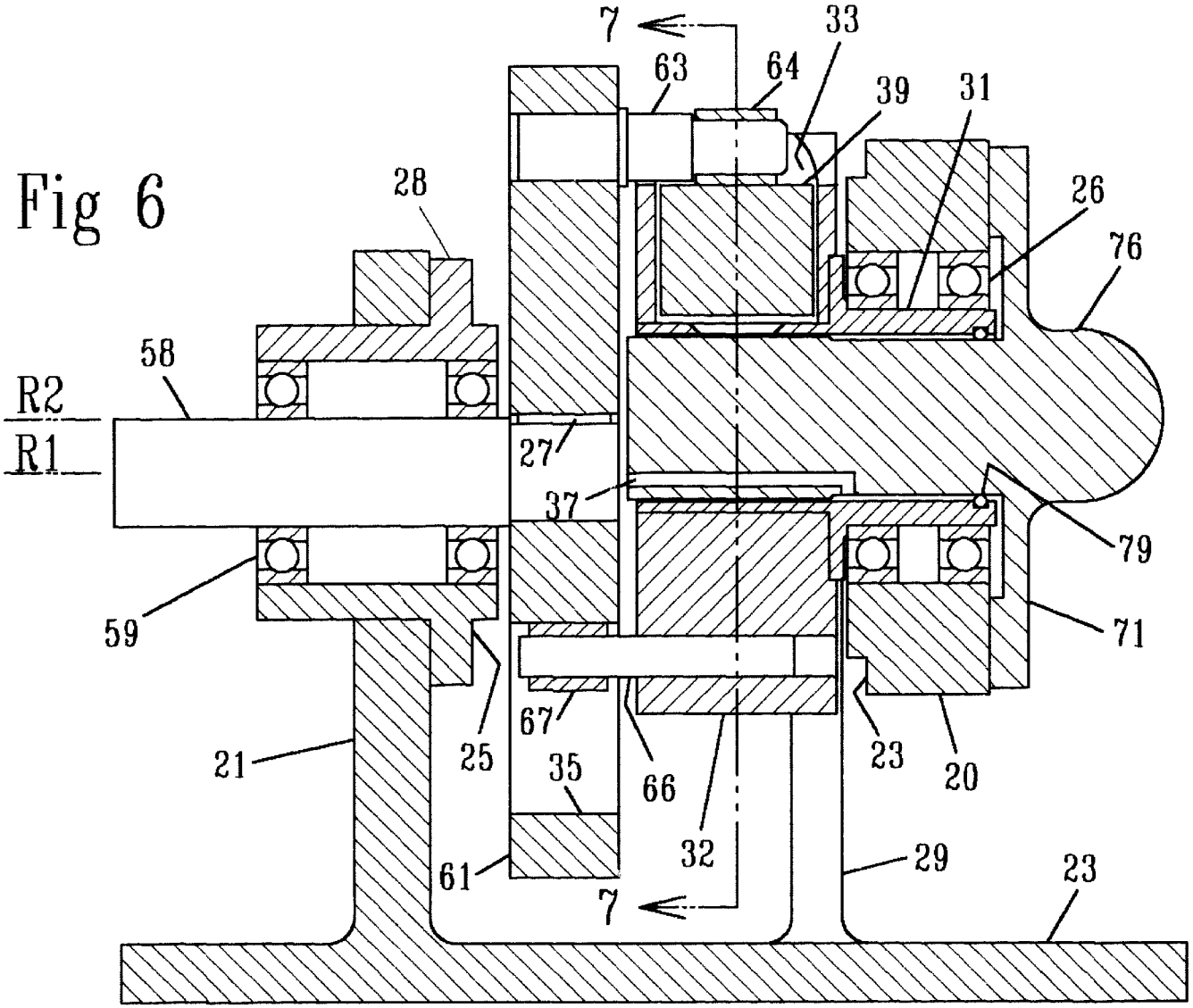

FIG. 6. A side view of the embodiment of FIG. 5, sectioned in the plane of the vertical midline as indicated by line 6—6 of FIG. 7.

Figure 7:
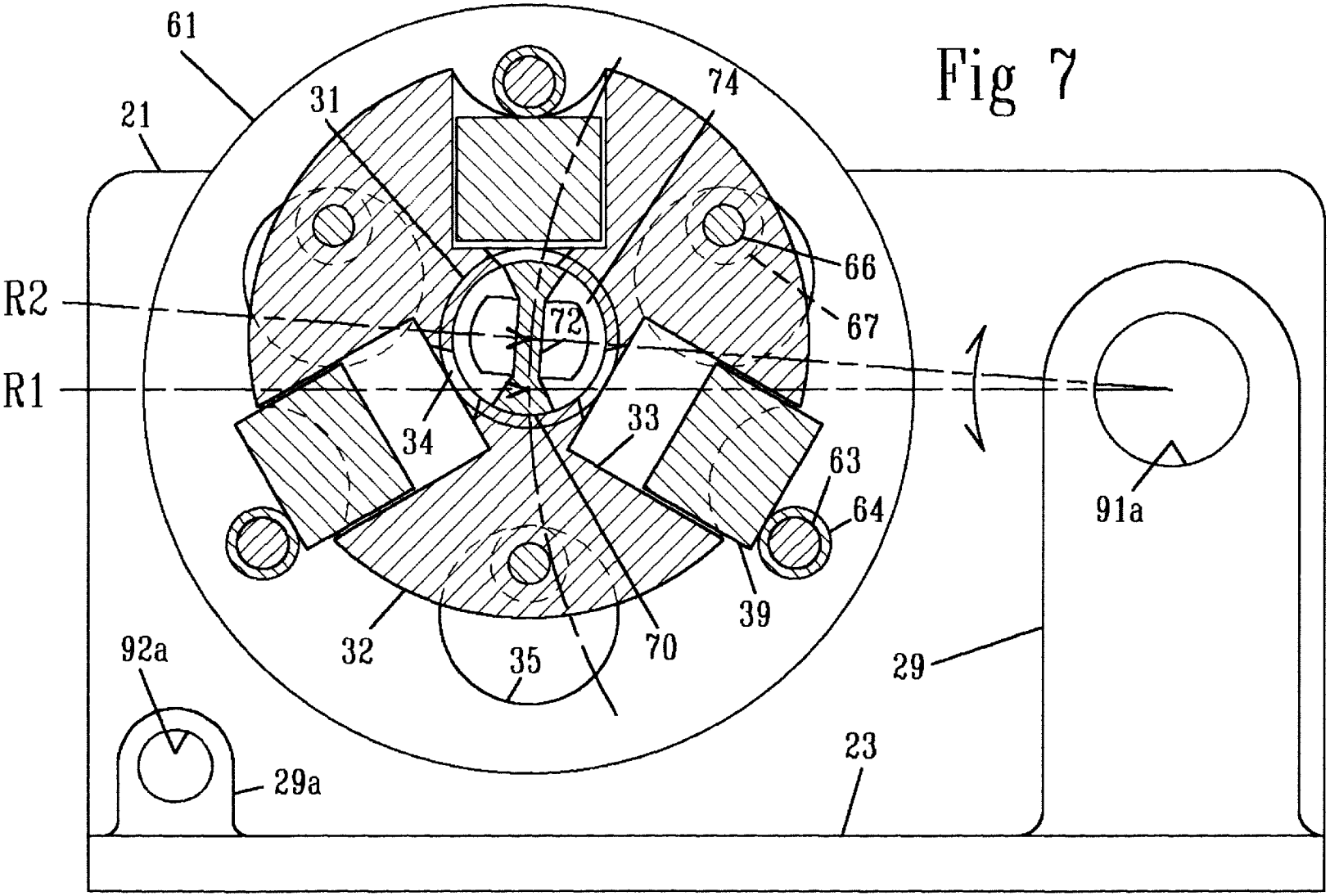

FIG. 7. A end view of the embodiment of the embodiment of FIG. 5 sectioned on the vertical midline as indicated by line 7—7 of FIG. 6.

Figure 8:
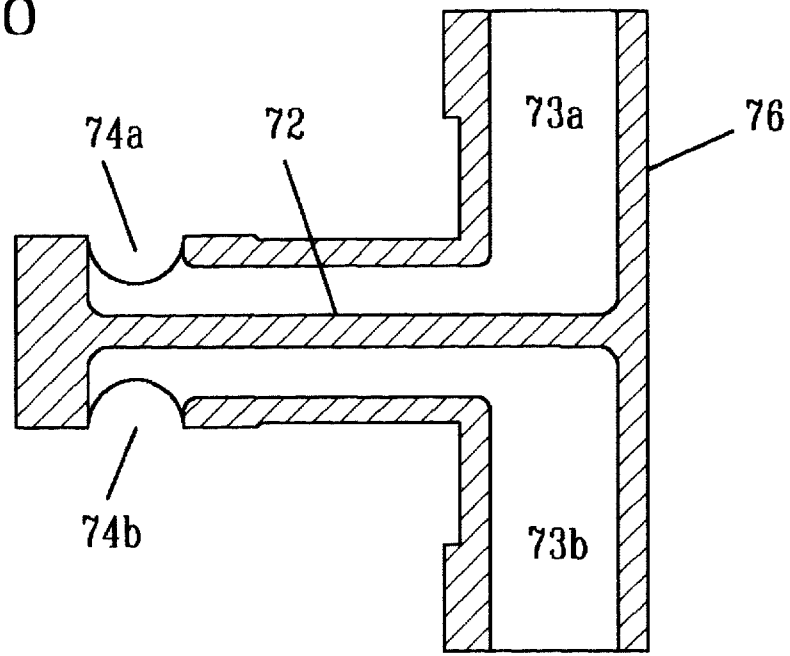

FIG. 8. A illustration of a valve preferred for use with the embodiment of FIGS. 5, 6, and 7.

Figure 9:
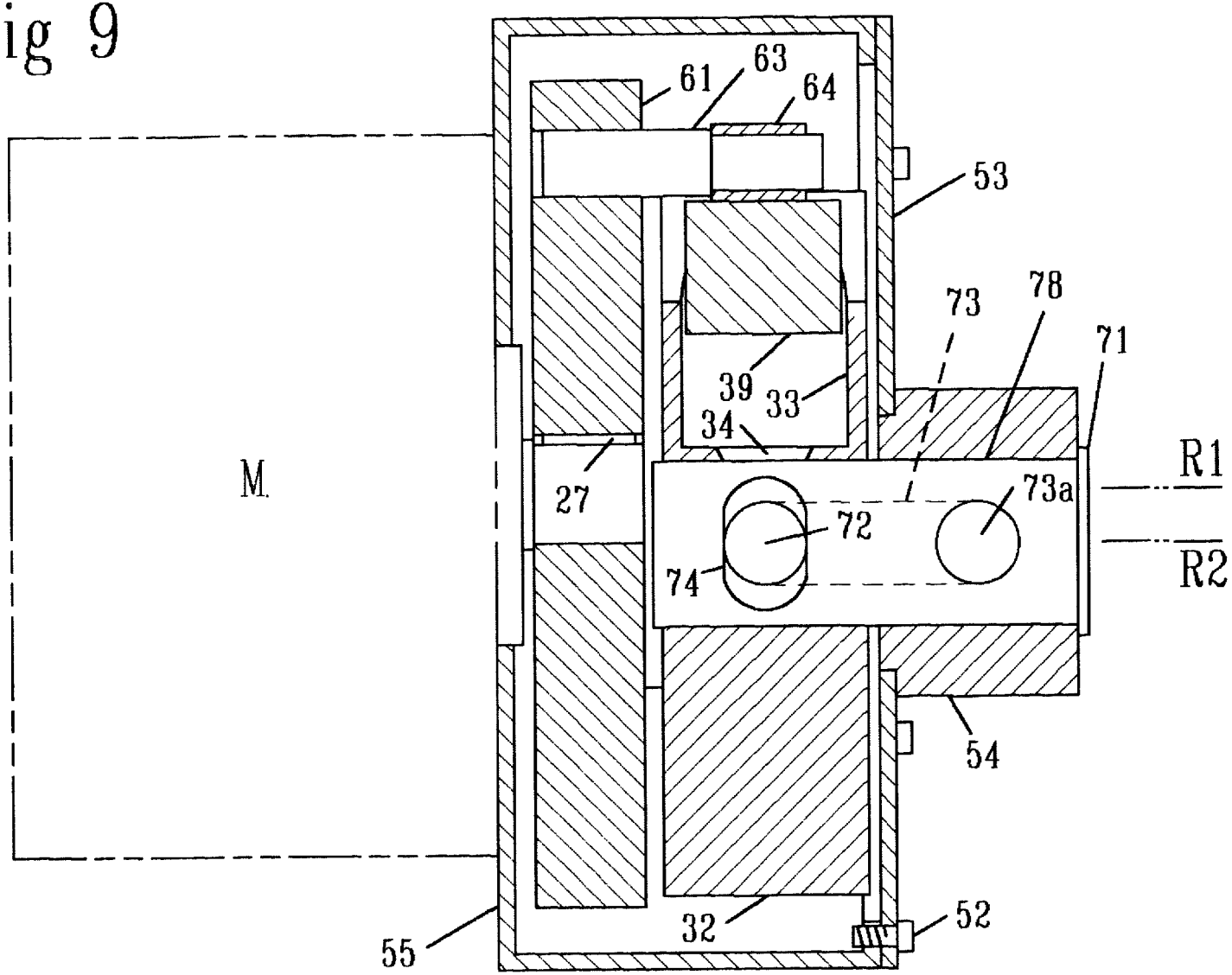

FIG. 9. A side view of simplified embodiment plane sectioned on the vertical midline with exception for the valve.

DESCRIPTION

A First Embodiment, Load Centered

FIG. 1. is a perspective view of an essentially complete device according to the present invention intended for service as a pump, compressor, fluid motor, or fluid metering device. The illustration of FIG. 1 is partially sectioned to reveal a method of construction and aid in comprehension. The device comprises a base 23 of flat or cast stock drilled and tapped on opposing edges as indicated by 22*a* to receive cap screws 22. A pair of flat, relatively thin, members made in mirror image form the upright fixed supports 21 and are attached to base 23 by cap screws 22.

Various matching and coaxially aligned holes are drilled or otherwise formed in each of the fixed supports, the largest in each support 21 mounting a cylinder rotor bearing 26. Each fixed support and bearing 26 rotatably supporting each end of a hollow or cored cylinder rotor shaft 31. Various coaxially aligned holes of generally smaller diameter indicated as 91*a* and 92*a,* are duplicated in each support. These holes support short dowels or linkage pins such as a pivot pin 91 and linkage pins 92, shown in FIGS. 2, and 3.

Only one of the fixed supports 21 need be drilled and tapped to receive cap screws 77 mounting a valve 70. Valve 70 has an elongated tubular body which extends into and beyond the distaff end of shaft 31. Flange 71 of valve 70 permits attachment of the valve to a support 21 using cap screws 77 as indicated, thereby positioning and preventing rotation of valve 70 within shaft 31.

A housing 50 comprises a matched pair of housing covers 53, each of relatively thin flat material and each attached to each end of a barrel 51 by machine screws 52. Each cover 53 is provided with a central opening, which is actually the hollow core of a piston rotor stub shaft 58*a,* the core of 58*a* being significantly oversized relative to the diameter of shaft 31, thereby permitting the protrusion of shaft 31 and valve 70 within shaft 31 therethrough with considerable radial clearance thereabout. A stationary seal 81 is installed in a groove machined in the inner face of each support 21. Each seal 81, when used, being normally made of a resilient material such as plastic or rubber, and each is normally held by compression of this material against a plane outer surface of each of the housing covers 53.

Each cover 53 is extended laterally thereby forming what may be described as an ear at each end. Each set of ears provided by paired covers 53 is drilled parallel to the shared axis of shafts 58*a,* each shaft 58*a* in the center of each cover 53. Holes 92*a* and 91*a,* thereby providing rotatable support for a linkage pin 92 and pivot pin 91, each of which positions and supports housing 50 as an assembly in regard to base 23 and most particularly, in regard to the axis of shaft 31. Pivot pin 91 is of a length which permits the protrusion of each end through similar holes 31*a,* coaxially aligned and provided in each support 21, thereby forming a pivoting or hinge type support permitting housing 50 to be rotated about the axis of pivot pin 91.

Referring to FIG. 3, one linkage pin 92, of suitable length and diameter is supported between opposing ears of covers 53 diametric to pivot pin 91 and rotatably connects a displacement adjustment mechanism 90 comprising a simple bellcrank 97 and a suitable connecting link or links 96. A second linkage pin 92 permitting rotation of a bellcrank 97, is supported by and between matching holes 92*a* in the lower right corner of each support 21, shown in FIG. 1. A third linkage pin, also 92, rotatably attaches link 96 connecting bellcrank 97 and housing 50.

FIG. 2, illustrates a side view of a embodiment essentially identical to that of FIG. 1, plane sectioned on the vertical midline. The matching supports 21 attached to base 23 by cap screws 22 described previously can be noted. Each support 21 is provided a cylinder rotor bearing 26, rotatably supporting shaft 31, a extension of a cylinder rotor 32, between bearings 26. Each support 21 also providing co-axially aligned holes supporting a linkage pin 92 and pivot pin 91, which in turn support housing 50 as previously described. Although not shown, several holes in base 23 can be provided for purposes of installing the device in regard to a suitable source of rotary power, such as a internal combustion engine, electric motor, or alternatively when the embodiment is used as a motor, in regard to a suitable driven device, (not shown).

In FIG. 2, the attachment of valve 70 to one of supports 21 by cap screws 77 and flange 71 is apparent as is the relative position of housekeeping seals 81. A short protrusion of each end of valve 70 beyond each end of shaft 31 can be threaded as indicated for connection of valve 70 to suitable external fluid system conduits, (not shown). Valve 70 is partially sectioned to reveal a hollow or cored interior. Slightly off center of the length of valve 70, a valve port 74*b,* one of two diametrically positioned valve ports 74*a* and 74*b* can be seen.

Sandwiched between the supports 21 is housing 50. Within housing 50, a piston rotor 61 is supported by housing covers 53, and cylinder rotor 32 is coupled for rotation with or as part of shaft 31. Piston rotor 61 of the load centered embodiment of FIGS. 1–3 comprises two matched disks 61*a* and 61*b,* each disk having a relative large central opening in the center thereof suitable for mounting a piston rotor bearing 59 therein. Needle roller bearings are indicated in FIG. 2, however other bearing types can be used and can be more suitable in regard to a particular application. Each bearing 59 is in turn, as previously noted, supported by each inwardly projecting hollow stub piston rotor shaft, shaft 53*a,* each a central part of each housing cover 53.

In FIG. 2, near the top of each piston rotor disk 61*a* and 61*b,* matching coaxially aligned holes used as bearings each rotatably support one end of a piston roller 64 between. By momentarily referring to either drawing of FIG. 3, it can be seen five piston rollers are provided, each sharing a common radius and each symmetrically disposed about the center of disks 61*a* and 61*b* comprising piston rotor 61. Each piston roller 64 limits outward radial displacement of each piston 39.

Small diameter weep holes 37 can be drilled in the wall of shaft 31 as indicated in FIG. 2, thereby permitting a working fluid which might otherwise be trapped in the running space, (a necessary operating clearance), between the inner wall of shaft 31 and outer wall of valve 70), to escape into the enclosing housing 50 previously described.

Housing 50 can be provided with openings such as a drain 57 provided in barrel 51. Other openings, (not shown), can be provided in either covers 53 or barrel 51 comprising housing 50 and each opening provided fitted with a suitable plug, cap, sensor, ventilator, etc., (not shown), as might be necessary or desirable in regard to a particular application. Drain 57 for example, permits a fluid lubricant using housing 50 as a reservoir to be removed or drain 57 can be used to direct internally leaked working fluid collected within housing 50, to a suitable point of recovery.

Cylinder rotor 32, having shaft 31 protruding coaxially therefrom, can be made of a single piece of material as indicated in FIGS. 2 and 3. If prepared as separate components, cylinders 33 are firmly coupled for rotation with shaft 31 by shrink or press fit, welding, or other suitable, means. A suitable pulley, gear, sprocket, etc., (not shown) can be coupled to a exposed end of shaft 31 using splines or a key and keyway 27*a* as indicated in FIG. 2, thereby providing a means of rotary coupling between cylinder rotor 32 and a suitable drive or driven device, (not shown).

One piston 39 and cylinder 33 of the embodiment can be seen in the section view of FIG. 2. Each cylinder 33 comprises a radial bore as indicated. At the inward end of each cylinder 33, a concentric opening or cylinder port 34 usually of smaller diameter than the bore of cylinder 33 is provided, thereby permitting communication of a suitable working fluid between a essentially fluid tight chamber within each cylinder 33, (a relatively displaceable outer wall defining the volume of this chamber being the inward end of each piston), and the core of shaft 31 via one of valve ports 74*a* or 74*b*.

Valve 70 has a considerable portion its length located within shaft 31 and can be provided with a slightly thicker section near each end and particularly at the end furthest from flange 71 and in a length of the valve 70 centered on the location of the common plane of rotation of each cylinder port 34. Also entered at the location valve ports 74*a* and 74*b* within the hollow body of the valve is a partition 72.

Partition 72 effectively divides the hollow interior of valve 70 into two discrete working fluid ducts 73*a* and 73*b,* (only 73*a* partially visible in FIG. 2), each providing a means of fluid communication from each open end of valve 70 to the diametrically located and generally slot-shaped valve ports 74*a* and 74*b,* (only 74*b* is visible in FIG. 2). The sectioned top view of valve 70 illustrated in FIG. 4 presents a better view of partition 72, working fluid ducts 73*a* and 73*b,* and valve ports 74*a* and 74*b*.

In FIG. 2, a seal 79 can be installed at each end of shaft 31. Each seal 79 allowed to rotate with shaft 31 against the inner wall of valve 70. Seals 79 are useful for housekeeping purposes as any working fluid leaked into the clearance space between shaft 31 and valve 70 is forced to exit via weep holes 37 rather than escaping through the running clearance space at the ends of shaft 31.

Two short parallel lines labeled R1 and R2 are indicated at the left side of FIG. 2. Each represents a relative location of one of two rotation axes R1 and R2, each a rotation axis of either piston rotor 61 or cylinder rotor 32, each rotation axis is parallel to and normally offset from the other in a working device. The offset of R1 and R2 is equivalent to the eccentricity between the main rotation axis and connecting rod bearing axis of a conventional crankshaft. Twice the offset spacing in a device according to the present invention is therefore equivalent to the piston stroke of a conventional reciprocating piston device as the term is commonly used in this regard.

The drawings of FIG. 3, FIGS. 3 and 3*a,* are essentially identical. FIG. 3 shows the embodiment in working mode as indicated by the offset between the rotation axis R2 relative R1 as emphasized by lines beginning at the center of pivot pin 91, each passing through R2 or R1 as indicated by the arrowhead. FIG. 3*a* shows the same embodiment in null mode where rotation axes R1 and R2 share a common position, (R2=R1). Each drawing of FIG. 3 is plane sectioned along line 3—3 of FIG. 2. Line 3—3 also representing the center of the plane of rotation of cylinder rotor 32.

In the drawings of FIG. 3, the inner surface of a housing cover 53 complete with laterally extended ears can be seen behind the sectioned barrel 51. The relationship of housing 50 supported only by pivot pin 91 and linkage pins 92, link 96, and bellcrank 97, in regard to base 23 and support 21 is apparent as is the rotatable support of bellcrank 97 provided by a linkage 92 and at least one support 21.

A scalloped notch or relief comprising a coupling guide 35 is machined at the end of, and centered on, the radial axis of each cylinder 33. Each coupling guide limits the relative lead or lag of a piston roller 64 relative to the angular position of each cylinder 33. The location of a coupling guide 35 at the end of each cylinder also provides maximum lateral support in the plane of rotation for each piston 39 when at maximum outward displacement within each cylinder 33, thereby permitting the use of pistons 39 relatively short in length. Each piston roller 64 is rotatably supported by and between matching bearing holes in each disk 61*a* and 61*b* comprising piston rotor 61. Only the outer portion of disk 61*b* being visible behind cylinder rotor 32 in FIGS. 3 and 3*a*.

Mechanical means is not normally provided to urge each piston 39 outward from the inward end of each cylinder 33. Forces generated by rotation during operation are instead primarily relied on to assure each piston 39 maintains contact with a piston roller 64. Essentially opposing surfaces of each coupling guide 35 assure each piston roller 64 cannot lead or lag each piston 39 to the extent that contact between each piston and each piston roller could be lost. Each piston 33 is thereby assured radially supporting contact by each piston roller 64 regardless of the offset between R2 and R1.

Each piston 39 in devices according to present invention intended for use as a pump or compressor can be solid as indicated in the drawing figures and weighted if necessary to provide adequate mass gain as a result of rotation at the operating speeds anticipated to ensure constant contact with each piston roller 64 radially supporting each piston during operation.

In a device intended for use as a fluid motor, pistons of minimal mass may be desirable for operation at very high speeds. For service as a motor however, the working fluid pressure can be relied on to press and hold each piston 39, where each may be purposefully made very light, against a piston roller supporting each piston even if the centrifugal force generated when operating at reduced speeds is inadequate to do so. If necessary in special applications where slow speed operation and high negative intake head pressures are expected, springs or other suitable means, (not shown), can be provided to assure relatively lightweight pistons cannot stick or hang-up at the bottom of cylinders 33.

The spacing between diametrically opposing surfaces provided by each coupling guide 35, or the diameter of each coupling guide 35, assuming a circle or segment of a circle is used as the shape of a coupling guide 35, is minimally twice the maximum design offset, (the maximum design offset being the maximum spacing permitted by design between rotation axis R2 of piston rotor 61 and rotation axis R1 of cylinder rotor 32), plus the diameter of a piston roller 64. The radius of the center of each piston roller relative the rotation axis of piston rotor 61 is equal to the radius of the center of each coupling guide relative to the rotation axis of cylinder rotor 32.

It is preferred that each coupling guide 35 be circular in form and enclose each piston roller 64 within, however, the overall diameter of cylinder rotor 32 of the embodiment of FIGS. 1–3 can be significantly reduced by using semicircular guides as indicated in the drawings of FIG. 3, thereby making for a more compact and lighter cylinder rotor as well as a lighter and more compact device overall. As a practical matter, each coupling guide can still be regarded as surrounding each piston roller as the orientation of one or more coupling guides 35 on the opposite side of cylinder rotor 32 can effectively provide the "missing", portion of each coupling guide.

Regardless of a slight lead or lag during offset operation it can be seen that each piston roller 64, each being symmetrically disposed about the axis of piston rotor 61, always supports the radial load imposed by each piston 39 on a piston roller symmetrically in regard to the rotation axis of piston rotor 61 even if each piston 33 is not always centered on piston roller 64 radially supporting it. Dynamic balance is therefore maintained at all operating speeds regardless of the relative position of, and offset spacing between, rotation axes R1 and R2.

Asymmetric and non-radially aligned piston and cylinder configurations are possible in a device according to the present invention, for example, pistons and cylinders need not be equally spaced apart and pair of co-parallel piston and cylinder sets can be aligned parallel to radii of and, include relative piston displacement along parallel chords of a cylinder rotor. Such configurations can have practical advantages. Embodiments using symmetric piston and cylinder arrangements however, have the advantage of being inherently balanced as produced and little addition attention is required in this regard.

In addition to lines defining the relative locations of rotation axes R1 and R2 in FIG. 3, a line describing an arc and passing through the rotation axis R1 and R2 is also indicated and having as its center the axis of pivot pin 91. The arc defined is the displacement adjustment arc D. Any offset of R2 relative to R1 must be locate R2 on displacement arc D, either above or below R1 given the orientation of the embodiment.

Ideally for purposes of maintaining precise valve timing as the offset is increased, displacement adjustment should be along a straight line rather than an arc, said straight line passing through both rotation axes R2 and R1 and at right angles to a line passing through the center of valve ports 74*a* and 74*b*. However, where the radius of an arc is the line of displacement and the arc radius is at least 10 times the length of the stroke, (twenty times the offset), displacement arc D approximates a straight line to the extent that for practical purposes valve timing is essentially unaffected.

FIG. 3*a* is, as previously noted, is identical to FIG. 3 with exception that R2 is positioned at the same location as R1. The offset is zero and the relative displacement is zero.

Cylinder rotor 32 and piston rotor 61 must cooperatively rotate concentrically. Cylinder rotor 32 can lead or lag rotation of piston rotor 61 or vice versa at zero displacement, (null mode), but normally leads the rotation of piston rotor 61 by several degrees as cylinder rotor 32 of the load centered embodiment is normally the rotor externally coupled for rotation with a drive or driven device.

When operated as a pump or compressor, cylinder rotor 32, is rotated by a motor or engine and therefore tends to initiate cooperative rotation of both rotors by causing each coupling guide 35 to make lateral contact with each piston roller 64. When set to zero displacement, (null mode), as shown in FIG. 3*a,* each piston roller 64 can make and maintain contact with a surface of each coupling guide 35 either leading or lagging the direction of rotation. At any displacement setting other than zero or either maximum displacement setting where R2 is offset from R1, (working mode), only one piston roller and coupling guide, (where coupling guides 35 do not completely encircle each piston roller 64), can be in contact with a surface of a coupling guide at any given point of cooperative rotation.

FIG. 4 shows a valve 70 suitable for use with the embodiment of FIGS. 1–3. Valve 70 is plane sectioned on the horizontal midline and shown in top view to better illustrate the angle of partition 72 dividing the hollow interior of valve 70 into discrete working fluid ducts 73*a* and 73*b*. Each duct 73*a* and 73*b* providing working fluid communication between each valve port 74*a* and 74*b* and each end of valve 70. Each end of valve 70 being provided with threads as shown or other suitable attachment means for connection of suitable external working fluid system conduits, (not shown).

A circumferential groove comprising a pressure guide 75 can be provided encircling valve 70 near and to either side of valve ports 74*a* and 74*b* to direct working fluid which might leak from valve port 74*a* or 74*b* exposed to the highest fluid pressure to the opposing valve port normally exposed to a fluid pressure substantially lower. When operating as a pump or compressor this permits leakage from the valve port used as a working fluid discharge to be directed to the opposing port serving as a working fluid intake and thereby included in the normal intake flow.

A suitable seal such as a O-ring, (not shown), can be installed in each pressure guide 75. The addition of such seals can be useful, particularly when it is desirable to minimize cross contamination between a working fluid and a fluid lubricant using housing 50 as a sump. When equipped with seals, it is recommended that each groove used to mount a seal be made slightly oversized thereby minimizing interference of each seal and the walls and bottom of each as said seals are rotated by contact with the inner wall of shaft 31.

Minimizing seal contact and load can be important in devices which can be expected to operate in null mode for extended periods. A device used as a pump or compressor and set to null mode cannot generate a working fluid pressure which tends to force seals into contact with the groove walls mounting the seals and wear and friction can therefore be significantly reduced during null mode operation.

A second valve embodiment 76, shown in FIG. 8, provides side by side fluid ducts 73*a* and 73*b*. Side by side ducting permits both external system fluid connections to be located at one end of valve 76 rather than a connection at each end as provided by valve 70 of FIG. 4. The valve 76 of FIG. 8 having a blind end can also be used with the load centered embodiment of the present invention described above thereby permitting one end of shaft 31 to be solid. Valve 70 of FIG. 4 however, is preferred in regard to the load centered embodiment as the diameter of valve 70 can be substantially smaller, which in turn minimizes the diameter of cylinder and piston rotor shafts, 32 and 53*a* respectively, and piston rotor bearings 59, while at the same time providing maximum fluid flow cross section area.

OPERATION

A First Embodiment, load centered

In the drawings of FIG. 3, the diametrically opposing openings of valve ports 74*a* and 74*b,* separated by partition 72, can be seen to occupy most of the circumference of valve 70 in the plane of section. The section plane indicated by line 3—3 of FIG. 2 also being the plane of rotation of cylinder rotor 32. In operation, rotation of cylinder rotor 32 rotates cylinder 33 and cylinder ports 34 about valve 70 in the plane of valve ports 74*a* and 74*b*.

Any cylinder port 34 in radial alignment with any part of a opening comprising one of valve ports 74*a* or 74*b* can communicate working fluid to or from within the cylinder it serves with that valve port 74*a* or 74*b* and the working fluid duct 73*a* and 73*b* within valve 70 in communication with that port or vice versa. Similarly, any cylinder 33 and cylinder port 34 in radial alignment as a result of rotation with any part of valve port 74*a* or 74*b* positioned diametrically is able to communicate fluid between that cylinder and a working fluid duct 73*a* or 73*b* leading to the opposite end of the valve body 70.

Any cylinder 33 and cylinder port 34 centered by rotation of cylinder rotor 32 on and therefore radially aligned near or along displacement arc D passing through both rotation axes R1 and R2, is blocked by the presence of the wall of valve 70 separating valve ports 73*a* and 73*b,* from working fluid communication with either valve port 74*a* or 74*b*. A segment of wall of valve 70 is also similarly positioned 180 degrees away and is also centered on displacement arc D. Any cylinder and cylinder port radially aligned by rotation with the wall of valve 70 at this diametric location is also prevented from fluid communication between that cylinder and either valve port and connecting working fluid duct within valve 70.

In FIG. 3*a,* it can be assumed that bellcrank 97 of FIG. 3 has been rotated counter-clockwise from the maximum displacement position of FIG. 3 by a suitable operator, for example a human, thereby causing R2 to share the location of R1. It can be further deduced that this counter-clockwise rotation of bellcrank 97 can be continued to a position of R2 providing a similar but opposing maximum offset spacing of R2 relative to R1, but below R1. In other words, a mirror image of the relative positions of R2 and R1 of FIG. 3 is possible.

The maximum offset of rotation axis R2 relative R1 is limited by contact between each piston roller 64 and the inward most surface of each coupling guide 35 as each in turn is cooperatively rotated to a position above and aligned with rotation axes R2 and R1. The dimensions and form of the coupling guides 35 can therefore be used define and limit the maximum offset allowed. It may be desirable, particularly if a spring means, (not shown), is used to urge and maintain maximum displacement, that a positive stop be provided. A pair of roll pins for example, (not shown), located with some precision both above and below the horizontal arm of bellcrank 97 can limit the maximum rotation of the bellcrank and therefore, of housing 50, thereby defining the maximum allowable offset of R2 both above and below R1.

In practice, and assuming other operating parameters such as the direction of rotation remain unchanged, reversing the location of R2 from above to below R1 or vice versa, changes the direction of flow in devices used as pumps or compressors. Reversing the offset position when used as a motor reverses the direction of rotation. As the working fluid has a very small inertia, the time needed to reverse the working fluid flow direction when the device is used as a pump or compressor is largely a function of the type of displacement adjustment mechanism provided.

Operating as a motor, the rotors, each having a significantly larger momentum than a working fluid can provide, and the added momentum of any externally driven device, must be first slowed by externally generated fluid pressure and the rotors and load stopped before cooperative rotation in the opposite direction can begin. A dynamic brake is therefore inherently provided, this brake being particularly effective if the displacement adjustment mechanism can reverse the offset position rapidly.

Virtually any mechanism capable of relocating the housing and piston rotor assemblies by causing limited rotation thereof as a unit can be used as a displacement adjustment means. For most applications the displacement mechanism provided should be of a type such as the bell crank mechanism shown, capable of providing reversal of the offset as quickly as practical. Applications requiring fluid flow volume metering on the other hand tend to favor displacement adjustment mechanisms which can provide displacement setting repeatability and accurate control. A hand or motor operated screw mechanism for example, (not shown), being one such device.

Regardless of the offset position, rotation of either rotor must cause a similar or cooperative rotation of the other as either the coupling guides 35 provided by cylinder rotor 32 will make contact with one or more of piston axles 63 supported by piston rotor 61, or vice versa In null mode, (zero displacement), as illustrated in FIG. 3A, one rotor, usually cylinder rotor 32 as it is the rotor directly coupled to an external drive or driven device, (not shown), simply leads the other until contact between each coupling guide 35 of cylinder piston rotor 32 is made with each piston roller 64 of piston rotor 61. All rotation in null mode is concentric and in well made devices provided with anti-friction or well lubricated bearings, null mode operation is virtually frictionless.

The embodiment can be operated as a pump, compressor, or fluid motor. Assuming operation as a pneumatic motor where the working fluid is ambient air compressed by a suitable remotely located compressor device, (not shown), and provided to the device via a suitable external working fluid conduit, (not shown). The conduit providing the compressed air working fluid can be attached to either end of the valve 70 using a threaded end as illustrated in FIG. 2 or other suitable means as may be appropriate. As the exhausted working fluid, (ambient air in this example), need not be recovered and can be harmlessly expelled, the opposing end of valve 70 need not be fitted with a working fluid conduit. In a closed fluid system, (a working fluid system continuously circulating a relatively small supply of working fluid), a suitable working fluid conduit must be attached to both ends of the valve 70.

In FIG. 3A, where the embodiment is in null mode and a distinction cannot be made between rotation axes R1 and R2, compressed air entering valve 70 via either of working fluid ducts 73*a* or 73*b* is directed to each cylinder 33 via a cylinder port 34 radially aligned with one of valve ports 74*a* or 74*b*. The embodiment, assumed to be idle and therefore not rotating at the time pressurized air is supplied, simply acts as a shut off valve. The presence of a piston within and effectively blocking each cylinder prevents the pressurized air from escaping the otherwise open end of cylinders 33, and, as only minimal running clearance between valve 70 and shaft 31 is provided in a well made device, the pressurized air is unable to escape through the running clearance between the valve and shaft in significant quantities.

In null mode as shown in FIG. 3*a,* operation as a motor cannot occur as the location of the piston roller radially supporting each piston is concentric to that of each cylinder and the piston radially aligned within each cylinder, regardless of the relative angular position the piston and cylinder rotors. A mechanical advantage between pistons 39 aligned by cylinders 33 of cylinder rotor 32, while radially supported by concentrically located piston rollers 64 provided by piston rotor 61 which could otherwise promote rotation cannot therefore be gained.

Referring to FIG. 3, and assuming a suitable operator such as a human has rotated bellcrank 96 clockwise, the housing 50, to include rotation axis R2 and the piston rotor 61, and particularly the common path or orbit each piston roller 64 must follow as each piston roller 64 is rotated about R2, must also be relocated above and offset and therefore eccentric in regard to the common path or orbit each cylinder 33 must follow as cylinder rotor 32 is rotated about R1. Each piston 39, although radially aligned and each spaced apart by the spacing of cylinders 33, is radially supported only by outward contact with each piston roller 64.

Any piston 39 within a cylinder 33 aligned by rotation of cylinder rotor 32 with displacement arc D, such as the piston and cylinder set upper most in FIG. 3, must be radially displaced within cylinder 33 for a distance equal to the spacing or offset between axes R2 and R1, in order to maintain contact between each piston 39 and piston roller 64 radially supporting it. Pistons 39 at other angular positions of cylinders 33 either permit outward or compel inward radial piston displacement as a function of the angular position of each cylinder 33 radially aligning each piston relative R1 and the offset between R1 and R2. Each piston 39 in a device in working mode is therefore continuously reciprocated within each cylinder 33.

Even though each piston 39 is obviously reciprocated relative each cylinder 33 and the volumetric capacity of a fluid tight chamber formed within each cylinder 33 is thereby substantially expanded and reduced each revolution, it is apparent that neither the pistons or cylidners are caused to undergo a substantial change of momentum. The angular momentum of piston rotor 61 and piston rollers 64 is also essentially unchanged. Each piston roller 64 however, while being collectively rotated is compelled to alternatingly rotate forward and back on its own axis as cooperative rotation in working mode occurs. The momentum of each piston roller is very small relative to that of a piston or cylinder for example, and therefore easily reversed.

When a compressed working fluid such as air is admitted to one end of valve 70, when in working mode as shown in FIG. 3, a duct 73*a* or 73*b* within valve 70 in communication with that valve end and a valve port 74*a* or 74*b* directs the air to one or more cylinder ports 34 aligned by rotation of cylinder rotor 32 with the opening of that valve port.

The air within each cylinder so exposed is permitted to expand by displacing each piston 39 away from the inward end of each cylinder 33 in communication with that valve port. Outward displacement of each piston however, can only occur if the piston roller 64 radially supporting that piston can be displaced further from the rotation axis R1 of the cylinder rotor 32. Rotation of the piston rotor 61 about R2, where R2 is offset in regard to R1, can allow this outward displacement of a piston as the eccentric orbit of the supporting piston roller can continuously allow outward radial relocation of that piston relative to the orbit of the cylinder aligning it for 180 degrees of cooperative rotation of the piston and cylinder rotors.

The piston rotor 61 is therefore encouraged to rotate about its own axis by the fluid pressure acting on the piston or pistons rotationally aligned with the valve port, either 74*a* or 74*b*, serving as a working fluid inlet. Rotation of cylinder rotor 32 must cause a similar and cooperative rotation of cylinder rotor 61 as a result of coupling forces which can include contact between at least one piston roller 64 and a surface provided by at least one coupling guide 35. The degree of encouragement or torque causing rotation and in turn compelling cooperative rotation is therefore directly related to the pressure of the working fluid supplied to the chamber of each cylinder being expanded by rotation and the spacing or offset between the rotation axes, R1 and R2, which provides the mechanical advantage.

As any cylinder 33 and cylinder port 34 becomes radially aligned by rotation with displacement arc D, that cylinder port is blocked from communication with either valve port 74*a* or 74*b* by the presence of the wall of valve 70 between and separating valve ports 74*a* and 74*b*. Further rotation of that cylinder and cylinder port past this point will again permit communication of that cylinder and cylinder port, but with the diametrically opposing valve port 74*a* or 74*b* in communication with the working fluid duct 73*a* or 73*b* serving as an outlet and leading to the end of valve 70 not attached to the pressurized working fluid supply. The working fluid, (compressed air as previously assumed), is expelled to ambient.

Continued cooperative rotation reduces the volume of the chamber within that cylinder for the next half revolution of the piston and cylinder rotors.

When that cylinder and cylinder port are once again radially realigned with displacement arc D, but below the location of the offset of R2 above R1, the chamber within that cylinder begins to be reexpanded as cooperative rotation continues. Each cooperative rotation performs a complete expansion and compression cycle of the chamber within each cylinder in turn.

General Features of a Second Embodiment, Load Overhung

Whereas the cylinder and piston rotors as well as the piston axles of the first embodiment are rotatably supported at both ends and the load supported between, the rotors and rollers of the second embodiment are supported by rigid attachment at one end and the load overhangs the attached ends of these members.

In FIG. 6, each piston roller 64 of the embodiment of FIGS. 5–7 is rotatable on a piston axle 63 supported at one end by piston rotor 61 rather than rotatable within and between bearing openings provided by the opposing and matched discs 61*a* and 61*b* comprising the piston rotor 61 of the first embodiment. As in the first embodiment each piston roller rotatably and radially supports a piston 39, pistons 39 being essentially identical in either embodiment. (The reader may note a slight difference in the top form of the pistons of each embodiment which will be explained. The shape of the piston top is not unique to either embodiment).

One intended application of the second embodiment which significantly influenced the detail of the embodiment illustrated involves service as a metering pump for process fluids, particularly concerning products suitable for consumption as food for humans and animals. The simple shapes of various members permits the use of various and often difficult to work materials required or customarily used in food processing at low cost. The device can be cleaned in place and can be provided with inexpensive, disposable seals and disassembled for sanitizing or seal replacement and reassembled with simple tools in a matter of minutes by production workers having minimal mechanical training. There are few, if any, crevices, in well made devices to encourage bacteria growth, no small parts with access to the working fluid system to be lost or easily broken, and the bearings can be isolated from the working fluid.

For edible product service using difficult or mildly abrasive fluids as working fluids, a constant drip of running water directed to the rotors can provide lubrication, thereby permitting the use of bushing type bearings. For severe service with such bearings, a small amount of a non-contaminating fluid having some lubricating properties such as vegetable oil, animal fat, etc., can be stored within a suitable housing or boot and continuously splashed by rotation of the rotors within said housing or boot.

It will also become apparent to the reader upon reading the following description, that the piston and cylinder rotors 32 and 61 respectively, as indicated in FIG. 5, are each a essentially a independent assembly can be easily and quickly separated by disconnecting the displacement adjustment mechanism, usually by removing one linkage pin 92 and sliding the displacement adjustment arm 20 from its rotatable mounting on pivot pin 91. The cylinder rotor 61 to include the attached housing 55, of FIG. 5, if used, is supported solely by pivot pin 91 and linkage pins 92 supporting the displacement adjustment device 90 and is therefore easily removed.

The pistons 39 are also easily removed, usually simply by rotation of the cylinder rotor 32 until the open end of each cylinder 33 is downward and gravity causes the piston to fall from within the cylinder. The pistons, (it is likely that pistons made of plastic or carbon material would be useful in this application), are simply discarded if excessively worn, or cleaned and any piston seals, if used, such as O-rings, (not shown), inspected and replaced as necessary. The valve 76 is similarly easily removed by removing cap screws 77 and withdrawing valve 76 from within cylinder rotor 32. Any seals which might be used to seal the valve clearance space are then also easily replaced if necessary.

DESCRIPTION

Second Embodiment, Load Overhung

In FIG. 5 a perspective view of a typical device according to the second embodiment is shown. A base 23 provides a mounting surface for a fixed rotor support 21 and a displacement adjustment pivot support 29. A displacement adjustment arm 20 is rotatably attached by a pivot pin 91 to pivot support 29. Approximately midway the length of arm 20, a valve 76 having a flange 71 and opposing valve ports 74*a* and 74*b* in communication with working fluid ducts 73*a* and 73*b* within valve 76, is attached thereto using cap screws 77.

The externally exposed openings of working fluid ducts 73*a* and 73*b* can be internally threaded or otherwise provided suitable means for attachment of external working fluid system conduits, (not shown). One working fluid duct

73*a* or 73*b* serving as a working fluid inlet, the other as a outlet. The openings through flange 71 of valve 76 for attachment thereof to arm 20 can be arcuate slots 77*a* as indicated thereby permitting limited rotation of valve 76 in regard to arm 20 for valve timing purposes.

At the distaff end of arm 20 opposing pivot pin 91, a linear actuator or displacement adjustment device 90 is attached as shown. The displacement adjustment mechanism or device shown is intended to be generic in nature and can be any one of several devices and mechanisms either new or old and known in the art capable of causing the extension or retraction of one end of the device or mechanism relative to the opposing end of device or mechanism 90. One of said displacement adjustment mechanism ends is rotatably affixed by a linkage pin 92, to the otherwise unsupported end of the displacement adjustment arm 20. A vang or mounting lug 29*a,* which can be rigidly attached to or part of base 23, is provided for the purpose of supporting the opposite end of displacement adjustment device 90 selected.

Some examples of suitable displacement adjustment devices or mechanisms include; electrically operated linear actuators, hydraulic or pneumatic cylinders, stepper motors used directly or in combination with screw, cam, or gear arrangements, to include mechanical linkage as shown in detail in regard to the embodiment of FIG. 3.

The single housing cover 53 of the second embodiment is essentially a rigid sheet of suitable material having a central opening to permit mounting on a shoulder 25 provided by a bearing block 28. Cover 53 of the second embodiment is not attached to barrel 51 as in FIG. 1, but is instead provided with a surface suitable for making plane contact with a projecting lip or rim provided by a otherwise open end of a housing 55. (Housing 55 can be regarded as an integration of barrel 51 and one housing cover 53 of the embodiment of FIG. 1). Housing 55 is provided with a central opening to permit supporting housing 55 on a suitable lip or shoulder 25 provided by arm 20. A suitable washer of a slightly compressible and resilient material such as rubber, (not shown), can be mounted on shoulder 25 thereby simultaneously providing both a fluid-tight seal and allowing self-alignment between the rim of housing 55 and the flat surface of cover 53. A molded seal, (not shown), also made of a suitable material such as rubber, can be provided between the rim or edge housing 55 and the plane surface of cover 53.

A solid piston rotor shaft 58 can be used in the second embodiment rather than the paired and coaxially opposed hollow stub shafts 58*a* of the first embodiment. Shaft 58 of the second embodiment also serves as the input-output shaft and is therefore the shaft coupled for rotation with a external driving engine, (not shown), or if used as a fluid motor, shaft 58 is coupled to a driven device, (not shown). In a overhung load embodiment, cylinder rotor 32, rotatably supported by the displacement adjustment arm 20, can be displaced relative to piston rotor 61 by limited rotation of arm 20 about pivot pin 91 for purposes of displacement adjustment. Piston rotor 61 being allowed only rotation by support 21 and bearing block 28, each being fixed in regard to base 23.

In FIG. 7, a end view is illustrated. The embodiment is sectioned on the vertical midline, (line 7—7), of the device of FIG. 6. The embodiment shown has three cylinder and piston sets although any reasonable number can be used. Each cylinder 33 of each piston and cylinder set comprises a cylindrical bore, each bore radially aligned 120 degrees apart. Each piston 39, usually a relatively short, solid, cylindrical shape having flat ends as generally are those of the first embodiment, is fitted within each cylinder 33 with the minimum lateral clearance possible while still permitting relatively free sliding radial displacement of each piston within each cylinder. Although not shown, piston rings or other suitable seals can be provided if desired or found necessary to augment sealing between each piston and the wall of each cylinder.

Cylinders 33 must rotate with shaft 31 as part of cylinder rotor 32. Each piston, allowed only radial displacement by each cylinder laterally enclosing each piston 39, must also rotate as cylinder rotor 32 is rotated. A piston roller 64 rotatably supported by each piston axle 63 defines and limits the outward displacement of each piston 39 within each cylinder 33. Each piston axle 63 is rigidly supported by attachment to or within piston rotor 61, each piston axle having a piston roller 64 rotatable thereon being also symmetrically disposed 120 degrees apart.

Each piston roller radially supports a piston and because this radial support is collectively provided only by piston rotor 61, radial support of each piston is essentially independent of small differences in the relative angular positions of cylinders 33 and piston rollers 64.

In adjustable displacement devices such as the embodiments of FIGS. 1–3 and FIGS. 5–7, either the piston or cylinder rotor can be offset relative to the other with each having a unique rotation axis spaced apart from and parallel to the rotation axis of the other. It is not essentially relevant which rotor is fixed and which is relatively displaceable. It is generally more convenient to cause and maintain relative displacement of the rotor not coupled for rotation with externally coupled devices such as motors or driven devices.

Relative displacement of cylinder rotor 32 as indicated in regard to the second embodiment by lifting or lowering the end of the displacement arm, can locate cylinders 33 and pistons 39 within cylinders 33 for rotation in a circular path or orbit eccentric to the orbit of each piston axle 63 and roller 64. Each piston 39, which must rotate with cylinder rotor 32, is normally held against a piston roller 64 by fluid pressure, centrifugal force, or some combination thereof, and can therefore be radially displaced within each cylinder 33 when both pistons and cylinders are cooperatively rotated in working mode, (R2 offset from R1), in a manner imitating conventional reciprocating piston displacement. It can be seen however, that the pistons are not required to undergo any significant change of momentum as reciprocating piston displacement is imitated.

Cooperative rotation of piston rotor 61 and cylinder rotor 32 in the embodiment of FIGS. 6–7, is assured by a rotor coupling means comprising a set of three coupling guides 35, each a circular coaxially aligned bore in the embodiment of FIG. 7 and each symmetrically disposed in piston rotor 61. Each bore comprising each coupling guide 35 has a diameter equal to twice the maximum allowable offset plus the diameter of a coupling roller 67, and each essentially surrounds a coupling axle 66. Each coupling axle 66 is rigidly affixed to or within, and projects outward from, the cylinder rotor 32 and each can have a coupling roller rotatable thereon. Each coupling roller 67 can be made of a resilient, wear resistant material such as rubber or plastic As in the first embodiment, the primary function of coupling guides 35 and coupling rollers 67 is to assure that each piston roller 64 always remains relatively positioned to radially support each piston 39. A primary cooperative rotor coupling function is also performed by coupling rollers 67 and coupling guides 35, particularly when the device is operated in null mode or when the offset spacing provides minimal relative piston displacement.

In most devices according to the present invention regardless of the embodiment, at least some torque coupling between cylinder rotor 32, and piston rotor 61 is performed by pistons 39 and piston rollers 64. The coupling effect caused by this contact tends to be proportionally less effective as the offset of R2 and R1 is decreased however, becoming negilible in null mode. It is therefore necessary to rely on contact between coupling guides and coupling rollers to assure cooperative rotation is maintained when operating at small to intermediate displacement settings or when simply rotating in null mode.

The share of the cooperative rotor torque coupling function performed by the pistons and piston rollers when operated in working mode relative to the share of coupling provided by the piston rollers and guides is primarily dependent on the shape of the piston top.

A imaginary line defining all the possible points of contact between a flat topped piston and a radially supporting piston roller will always be tangent to a radius of R1, defining the rotation axis of cylinder rotor 32. A imaginary line defining the orbit of each piston roller 64 however, must be circle having as its center R2, the rotation axis of piston rotor 61. In order to permit a piston roller to lead or lag the piston it radially supports as required by offset or working mode cooperative rotation of both rotors, the point of contact between each piston and each piston roller must always be on the arc of the piston roller orbit and cannot be maintained tangent to a radius of R1 unless the form of the piston top also describes an arc or dome shape of appropriate radius or the piston is relatively displaced slightly to cause the point of contact between the piston and piston roller to lie on the piston roller orbit.

A piston having flat or concave top can therefore only allow lateral displacement, (lag or lead), of a supporting piston roller by being proportionally displaced inward and outward each 180 degrees of cooperative rotation. In other words, the orbit of each piston having a flat or concave top form must become slightly eliptical while the relatively eccentric orbits of each piston roller and cylinder must each remain circular as cooperative rotation in working mode occurs.

It would seem logical to attribute a relatively high inertia to each piston. The mass of each piston 39 being magnified by centrifugal force and can also be magnified for roughly one half each revolution by a positive fluid pressure generated by, or supplied to, the chamber of each cylinder 33. Pistons 39 would therefore tend to alternatingly resist any attempt of a piston roller 64 radially supporting that piston to deviate that piston from a circular orbit. It is therefore presently believed that a part of the energy required which otherwise must cause this slight radial inward and outward displacement of the piston must be used instead to in an attempt to accelerate or slow one rotor relative to the other.

The rotors however, and in particular one rotor, as one is commonly coupled to an external load or driving engine, tend to have a relatively large angular inertia and therefore tend resist being either slowed or accelerated. A effect then of this resistance of each piston and each rotor to a change of momentum which must result in a radial deflection each piston or to a slowing and acceleration of at least one of the rotors apparently results in a coupling effect between the rotors.

At least one rotor and each piston in turn finding it easier to share the momentum changes required by offset operation and thereby promote cooperative rotation of both rotors at essentially identical speeds without benefit of the positive coupling effect provided by contact between coupling guides and coupling rollers. (The piston roller 64 of the first embodiment, in addition to radially supporting a piston, also performs the function of a coupling roller 67 and coupling axle 66 of the second embodiment).

Cooperative rotor coupling performed without reliance on contact between the piston rollers and the coupling guides apparently promotes smooth operation; smoother than might be reasonably expected by cooperative coupling due to a series of contacts made between each coupling guide 35 and coupling roller 67, particularly when only a few are used. Although testing is inconclusive at this time, it would appear that contact between the coupling guides and piston or coupling rollers is such devices need only be relied on to assure each piston is always radially supported and to guarantee cooperative rotation.

It is not possible to state with confidence the advantages and disadvantages, if any, in regard to operation with various piston top configurations. A prototype has demonstrated that flat topped pistons used in combination with piston rollers which also serve as coupling rollers works very well in the five piston embodiment of FIGS. 1–3, using the valve 70 of FIG. 4, having a bore to stroke ratio of roughly 2:1. This is convenient as pistons with flat tops are simple and inexpensive to produce. Successful operation with pistons having a flat top also tends to indicate that complicating the piston shape or the rotor coupling system generally is probably unnecessary to provide satisfactory service in most applications.

A preferred method of mounting cylinder rotor 32 in regard to the second embodiment is shown in FIG. 6. One end of a relatively short, hollow, thin walled cylinder rotor shaft 31 is press fit, welded, or other wise suitably attached to or within, and protrudes from, cylinder rotor 32. Shaft 31 being then rotatably supported by suitable cylinder rotor bearings 26 installed within arm 20. The body of valve 76, having flange 71 affixed thereto to mount and align valve 76, is installed within the core of shaft 31. The external working fluid system connections for working fluid ducts 73*a* and 73*b* are located beyond the end of shaft 31 and external to arm 20. A small bore duct serving the function of weep hole 37 permits any working fluid leaked into the valve clearance space to be drained to, and collected within, housing 55.

According to the embodiment of FIGS. 5–7, cylinder rotor bearings 26 are easily protected from the working fluid and contact between the rotating shaft 31 and valve 76 is substantially eliminated, thereby permitting the device to be run dry, or operated for extended periods in null mode, while also allowing the device to be used with nearly any liquid or gas as a working fluid.

In stand alone or modular embodiments, (a embodiment which needs only attachment to a external working fluid system and suitable rotary coupling means attaching either the piston or cylinder rotor to a suitable driving engine or driven device as indicated in FIGS. 5 and 6), piston rotor 61 is rotatably supported by piston rotor bearings 59. Bearings 59 can be pre-lubricated and sealed types or protected from the working fluid using suitable seals installed nearby, (not shown), dedicated to this purpose.

As previously noted in regard to the first embodiment; ideally displacement adjustment would occur directly along a line perpendicular to a line passing through the center of both diametrically positioned valve ports 74*a* and 74*b* as seen in the sectioned end views of FIG. 3 and FIG. 7. While several mechanisms old and known in art are available which can rigidly support overhung loads imposed parallel to the direction of displacement adjustment, such as circular bushings and guide rails, V-ways, and slideable mating dovetail joints for example, the hinged or pivoting mechanism illustrated is preferred because it is easy and inexpensive to make and maintain.

The length of displacement adjustment arm 20 need not be excessively long before a close enough approximation to straight line motion over the range of the relatively short rotation axes offset distances involved can provide satisfactory performance in most types of service. It is also relatively simple matter if necessary to provide a simple linkage, (not shown), capable of rotating a suitable valve, for example valve 76, a few degrees proportionally in the appropriate direction as the displacement offset is changed. This proportional rotation of the valve thereby maintaining the desired valve orientation relative to a particular angular position of the displacement adjustment arm as defined by the displacement setting setting selected by the operator.

The use of a valve timing linkage as described allows a short displacement arc radius while maintaining precise valve timing at all offset positions. A automatically compensating valve timing linkage as described can be particularly useful in regard to high pressure devices where the overhung load can contribute to significant twisting or torsion of the displacement adjustment arm, particularly when the arm 20 would otherwise be required to be pivotably supported a significant distance from the point the overhung load is applied to assure necessary valve timing accuracy.

FIG. 8 is a top view of the valve 76 using in the embodiment of FIG. 6 showing the internal partition 72 which, unlike the angled partition of valve 70, extends parallel within most of the length of the valve 76. Whether angled or parallel, the partition 72 divides each valve 70 or 76 into two discrete internal fluid ducts 73*a* and 73*b*. Each duct permits fluid communication between one of the two internal valve ports 74*a* and 74*b* and a suitable external fluid system, (not shown), however valve 76 can provide both working fluid connections to the external fluid system at one end of the embodiment rather than at each end as in valve 70.

DESCRIPTION AND OPERATION

A Third Embodiment

A third preferred embodiment is illustrated in FIG. 9, which provides a internal valve in the manner of the embodiments of FIGS. 5–7, but allows the cylinder rotor 32 rotate directly on and thereby use a non-rotating valve essentially identical to the valve 76 of FIG. 8, thereby obviating the need for a hollow cylinder rotor shaft 31 per se.

The valve 78 of FIG. 9 differs in appearance from valve 76 in that flange 71 providing the external working fluid system connections as indicated in FIG. 8 need not be provided or can be much smaller as indicated in FIG. 9. A reinforced eccentric portion 54 of a housing cover 53, (or a adjustment displacement arm 20 when equipped for variable displacement), provides the material structure necessary to form a suitable external fluid system attachment means such as internal threads, (not shown), thereby permitting working fluid communication between each of the working fluid ducts 73*a* and 73*b* within valve 78 and a external working fluid system.

The displacement of the embodiment of FIG. 9 is fixed by design. The fixed displacement design shown can be applied to other embodiments described herein simply by omitting the displacement adjustment means and mounting the cylinder and piston rotor supports in a fixed relationship as exemplified in the illustration of the embodiment of FIG. 9.

For service in applications where displacement adjustment is not required, the housing 55 including the reinforced portion 54 can be rigidly attached to the housing cover 53 as shown using any suitable means such as machine screws 52. Piston rotor 61, can be directly coupled to the output shaft of a suitable motor M, using a suitable keyways and key 27, thereby obviating the need for piston rotor shaft 58, fixed support 21, piston rotor bearing block 28, and piston rotor bearings 59, as shown in FIGS. 5–7.

The output shaft of motor M and piston rotor 61 are centered in regard to housing 55, said housing being attached using any suitable means to motor M. Valve 78, which also serves the purpose of shaft 31 of previous embodiments shown, is located and supported by press fit, set screws, (not shown), or other suitable means within a suitable bore provided in a reinforced central area 54 of cover 53, thereby positioning valve ports 74*a* and 74*b* in the plane of rotation of cylinder rotor 32 and preventing rotation of said valve as cylinder rotor 32 is rotated thereon.

The motor output shaft serving as the piston rotor shaft 58, and the housing 55, and piston rotor 61 rotatably coupled with said shaft, all share a common axis indicated as R1. The valve 78 and the reinforced eccentric portion of the housing cover 53 supporting the valve and the cylinder rotor rotatable thereon share a second rotation axis R2. Rotation axis R2 is therefore offset, being positioned below and parallel to R1. Both rotation axes R1 and R2 are fixed in a non-adjustable or fixed displacement device and the offset spacing is determined by locating the reinforced eccentric portion 54 of cover 53 eccentric in regard to the circular layout of machine screws 52 attaching the cover 53 to housing 55 as well as to the true center of cover 53 itself.

In keeping with the simple nature of the embodiment, cooperative rotor coupling is assured by piston axles 63 rotatably supporting each piston roller 64 located essentially within a suitably formed crossbore or relief in the piston rotor 32 acting as coupling guide 35. Each coupling guide 35 being positioned at the end of each cylinder 33 in the manner of the cooperative rotor coupling of the load centered embodiment of FIG. 3. Each piston axle 63, although not independently rotatable serves the purpose of a piston roller 66 as used in the first embodiment and a coupling axle 66 and coupling roller 67 as used in regard to the second embodiment.

The use of machine screws 52, to rigidly attach the housing and housing cover permits a suitable gasket, (not shown), to be installed at the juncture of the housing members thereby providing a essentially leak free housing assembly. A suitable lubricant can therefore be stored within, or internally leaked working fluid can be collected by, and temporarily stored within the housing. When used as a sump for leaked working fluid the leaked working fluid can be directed to a suitable recovery or disposal means, (not shown). Assuming a suitable lubricant is stored within housing 55 and cover 53 as a assembly, the lubricant can be agitated by rotation of rotors 32 and 61 and used to constantly lubricate various members such as the pistons 39, the walls of cylinders 33, and piston rollers 64 during operation. This is particularly useful when the working fluid is ambient air and any leakage can be simply vented from the housing.

In applications where the working fluid is inherently capable of, or can be admixed with, a substance which can provide friction reduction appropriate to the application, (for example, a working fluid such as oil or a mixture of oil and air), a embodiment such as that of FIG. 9 which eliminates cylinder rotor bearings 26 and the cylinder rotor shaft 31 per se as an adjunct to cylinder rotor 32 by using valve 78 as a rotational support can be useful and reliable while being inexpensive to produce.

As noted the embodiment of FIG. 9 can be easily provided with a suitable variable displacement mechanism such as the hinged or pivotable housing or displacement arm previously described in regard to the second preferred embodiment if desired while still being significantly less expensive to produce than other embodiments described as well as in regard to most prior art devices of similar capabilities regardless of type.

OPERATION

General

Two distinct operating modes; working mode and null mode, are possible in variable displacement devices according to present invention. In working mode the rotation axes R1 and R2 are always offset. The offset can be any distance from zero to design maximum and the displaceable rotor axis may be positioned on either side of the fixed rotor axis. In working mode some relative radial displacement of an apparently reciprocating nature or Virtual Reciprocation is always required by the pistons 39. In a well made device according to the present invention capable of near zero slip, rotation in working mode when in service as a pump must cause volumetric fluid displacement proportional to the offset distance of any working fluid available to the working fluid duct and valve port, 73*a* and 74*a,* or 73*a* and 74*b,* serving as the intake of the device.

In null mode operation only rotation of the cylinder and piston rotors at identical speeds about a shared rotation axis, (R1=R2), is required and therefore radial reciprocating displacement of the pistons in regard to the cylinders can not occur. The rollers, to include both piston and coupling rollers while each can be in contact with a piston or coupling guide respectively, are not required to rotate independently. Rotational forces tend to cause any working fluid within the cylinders to be simply rotated with the cylinders until such time as the device is adjusted or readjusted to working mode. When used as a motor and rotated while set to null mode, working fluid flow through the device is essentially uninterrupted.

Null mode has several uses depending on the application and whether the device is used as a motor, compressor or pump. In a embodiment operated as a pump or compressor, a relatively inexpensive electric motor type can be used. Such motor types often display poor starting torque characteristics but can be brought up to speed thereby achieving maximum power before fluid displacement is initiated. When driven by a internal combustion engine, clutches or pressure unloading devices are redundant as it is usually a relatively simple matter to provide a mechanism for changing the device from working to null mode or vice versa as load demand changes.

Most embodiments of the present invention regardless of the working fluid or application can be rotated in null mode indefinitely; friction and wear is negligible. The momentum of a embodiment while operating in working mode is identical to one rotating in null mode. The change from working to null mode or vice versa can therefore be made very rapidly. In the case of service as an air compressor for example, a suitable automatic operator and displacement adjustment mechanism can respond quickly enough to changes in load demand so as to make provision for air storage unnecessary. Compressor efficiency is increased as must of the adiabatic heat of compression can be recovered rather than discarded or lost as often results from storage of compressed gases.

In a device according to the present invention used as a power transmission device, null mode operation provides a useful neutral flow and pressure position equivalent to the neutral shift position often provided in well known and commonly used power transmission devices using gears.

SUMMARY, RAMIFICATIONS, AND SCOPE

Embodiments produced according to the present invention have been tentatively named Virtual Reciprocation Devices. The name is appropriate because the positive effects and advantages of conventional reciprocating piston displacement are duplicated while the undesirable effects of reciprocating inertia, a inescapable characteristic of true reciprocating displacement, are essentially obviated.

Cylinders and pistons of circular cross section can be used in a virtual reciprocation device thereby permitting the use of simple, efficient, inexpensive, minimum friction, contact seals such as piston rings. Piston speeds and contact seal velocities are minimized and piston displacement is along and perpendicular to wall each cylinder as in conventional reciprocation piston devices thereby substantially increasing seal life, efficiency, and reliability.

Rapid and reversible variable displacement and the ability to use fluids of widely disparate properties in combination with the low slip, low friction, and the capability of operation for extended periods in null mode, all features of the present invention, can provide objects and advantages in addition to those previously noted as yet not entirely understood or explored. In addition, embodiments providing these features tend to be inherently sturdy, reliable, and easy and inexpensive to produce and maintain.

The advantages and ramifications of pistons having various top shapes in regard to cooperative coupling of the piston and cylinder rotor is also not yet fully understood or explored As previously noted, tests of a prototype having flat topped pistons have been very encouraging. Examination for wear of various prototype components after several hours of operation as a motor using water and compressed air at pressures between 40 and 120 psi shows no obvious marking, with exception for scuffing of a unpolished mild steel cylinder rotor shaft used with hardened steel needle roller bearings.

It is readily apparent that the preferred embodiments and possible applications of the present invention as described herein are but a few of many which can be devised by a person reasonably skilled in the art. It is therefore respectfully requested that although the present application contains many specificity's, these should not be construed as limitations on the scope of the present invention but as merely providing illustrations of some of the preferred embodiments thereof.

For example, persons skilled in the art might propose a piston providing a axle having a roller rotatable thereon, or propose a piston having a socket having a ball rotatable therein. The outwardly exposed portion of each roller or ball of each piston so equipped caused by centrifugal forces to be held in radial contact with and therefore radially supported by a inward surface of a surrounding band or circular track attached to the rim of the piston rotor.

Using each piston to rotatably support a roller or ball held in contact with a radially supporting surface while said surface is cooperatively coupled with, or simply encouraged by contact friction between said rollers or balls and said track, for rotation in the plane of rotation of the pistons has obvious advantages, but is not preferred. The angular spacing between each point of supporting radial contact between each roller or ball supporting each piston and the track provided by the piston rotor must constantly change when operating in working mode. The proposed embodiment described can therefore not be dynamically balanced when operated while the track is offset from the rotation axis of the cylinders.

A variation of the embodiment proposed above, might also propose the radially supporting band or track also serve as the housing barrel and not be cooperatively rotated with the cylinder rotor, but instead held motionless as the cylinder rotor and pistons, each piston independently rotatably supported by said track are rotated eccentrically within. A advantage is immediately obvious in that the embodiment is significantly simplified, however, the roller or ball rotatably supporting each piston must be relatively small and therefore must rotate very rapidly while in forceful contact with the encircling track.

Thus the scope of the invention should be determined by the appended claims and their legal equivalents, rather than reliance on the examples given.

| Reference Numbers | |
|---|---|
| 1–20. | Reserved for Drawing Figures. |
| 21 | fixed support |
| 22 | cap screw |
| 25 | mounting shoulder |
| 26 | cylinder rotor bearing |
| 27 | key, (29a, keyway) |
| 28 | bearing block |
| 29 | pivot support (29a, lug) |
| 31 | cylinder rotor shaft |
| 32 | cylinder rotor block |
| 33 | cylinder |
| 34 | cylinder port |
| 35 | coupling guide |
| 39 | piston |
| 50 | rotor housing assembly |
| 51 | barrel |
| 52 | cap screw |
| 53 | housing cover |
| 55 | closed end housing |
| 57 | drain opening |
| 58 | piston rotor shaft, (58a, dual shafts) |
| 59 | piston rotor bearing |
| 61 | piston rotor |
| 63 | piston axle |
| 64 | piston roller |
| 66 | coupling axle |
| 67 | coupling roller |
| 70 | valve, axial ducts |
| 71 | valve flange |
| 72 | valve partition |
| 73 | valve duct |
| 74 | valve port |
| 75 | pressure guide |
| 76 | valve, parallel ducts |
| 77 | cap screw |
| 78 | valve, no flange |
| 79 | seal, valve |
| 81 | seal, housekeeping |
| 90 | displacement adjustment device assembly |
| 91 | pivot pin |
| 92 | linkage pin |
| 96 | link |
| 97 | bellcrank |

What is claimed is:

1. In a fluid power device comprising:

(a). a cylinder rotor support rotatably supporting a cylinder rotor for rotation about a first rotation axis, (b). a piston rotor support rotatably supporting a piston rotor for rotation about a second rotation axis, said piston rotor support normally positioned to locate said second rotation axis a predetermined distance offset from and parallel to said first rotation axis, (c). said cylinder rotor providing a plurality of radially aligned cylinders including a piston slidable within each said cylinder and collectively rotatable about said first rotation axis while sharing a plane of rotation normal to said first rotation axis as said cylinder rotor is rotated about said first rotation axis, (d). said piston rotor providing a plurality of piston rollers, each said piston roller angularly spaced apart about said piston rotor and corresponding to the angular position of each said cylinder, each said piston roller independently rotatably supported by said piston rotor for rotation about a piston roller axis aligned parallel to said first and second rotation axis and collectively rotatable about said second rotation axis in said plane of rotation of said plurality of cylinders, (e). means for urging outward displacement of each said piston thereby causing a top of each said piston to maintain contact with each said piston roller, (f). each said cylinder having valving means for entry and egress of a suitable working fluid at predetermined points of rotation of said cylinder rotor, (g). a rotor coupling means for assuring said piston rotor and said cylinder rotor rotate at similar speeds in the same direction.

2. The device of claim 1, wherein:

said means urging outward displacement of each said piston is centrifugal force generated by rotation of said cylinder rotor.

3. The device of claim 1, wherein:

(a). said valving means includes a cylinder port penetrating the inward end of each said cylinder, thereby permitting communication of said working fluid between each said cylinder and a central opening within said cylinder rotor, and, (b). a valve, said valve having a tubular portion positioned within said central opening substantially prevented from rotation by attachment between a flange provided near one end of said valve and said cylinder rotor support, said valve internally partitioned to provide two coaxially aligned and discrete working fluid ducts within, each said working fluid duct providing for communication of said working fluid between one of two external working fluid system connections provided by said valve and at least one internal valve port, each said internal valve port diametrically located relative the other and positioned within said central opening within said cylinder rotor to share a plane of rotation of each said cylinder port as said cylinder rotor is rotated.

4. The device of claim 1, wherein:

(a). said rotor coupling means comprises a plurality of coupling guides supported for collective rotation by said cylinder rotor for rotation about, and at a predetermined radius as measured from said first rotation axis defined by said cylinder rotor support, each said coupling guide providing a series of surfaces which can act in cooperation with surfaces provided by the same and other said coupling guides to limit angular displacement of said piston rotor and said cylinder rotor by contact between said surfaces provided by at least one of said coupling guides and, (b). at least one of said plurality of piston rollers supported by said piston rotor for collective rotation about, and at said predetermined radius as measured from said second rotation axis defined by said piston rotor support, each said surface provided by each said coupling guide spaced apart from a corresponding surface of each said piston roller a minimum distance equal to a predetermined maximum offset spacing between said first and second rotation axis.

5. The device of claim 1, wherein:

(a). said rotor coupling means comprises a plurality of coupling guides, each said coupling guide comprising a series of surfaces substantially defining a circular opening, each said coupling guide spaced apart and supported for collective rotation by said piston rotor about, and in a predetermined orbit relative to said second rotation axis, each of said coupling guides effectively surrounding, (b). a coupling axle corresponding to each said coupling guide and provided by said cylinder rotor, each said coupling axle collectively supported by said cylinder rotor for rotation about said first rotation axis at said predetermined orbit relative said second rotation axis, each said coupling guide having a predetermined diameter equal to twice said predetermined maximum offset spacing between said first rotation axis and second rotation axis plus the diameter of a corresponding coupling axle, each said coupling axle can have a coupling roller rotatable thereon and when so provided said predetermined diameter of each corresponding coupling guide is twice said predetermined offset plus a diameter of each said coupling roller.

6. The device of claim 1, wherein:

said rotor coupling means comprises in part, a top form, to include convex, concave, and flat, in regard to the shape of said top of each said piston, each said top form calculated on the basis of empirical evidence to perform a proportional share of said rotor coupling function.

7. The device of claim 1, wherein:

said central opening of said cylinder rotor comprises a bearing and said cylinder rotor is rotatable about and uses said tubular portion of said valve as a shaft rotatably supporting said cylinder rotor.

8. The device of claim 1, wherein:

(a) said cylinder rotor support comprises a pair of fixed supports sandwiching a pair of opposingly mounted housing covers between, each said fixed support attached, using cap screws or other suitable means, to an opposing edge of a base and thereby spaced apart to permit relative displacement of said housing covers as a unit normal to said first rotation axis between said fixed supports, and, (b). said piston rotor comprises a coaxially aligned pair of disk-like members rotatably supporting each said piston roller between, with each said disk-like member rotatably supported by a piston rotor bearing mounted on a hollow stub shaft provided by each said housing cover, each said disk-like member and each said housing cover positioned at each end of said cylinder rotor, a hollow cylinder rotor shaft, a coaxial central extension of said cylinder rotor, protrudes through each said hollow stub shaft with each end of said hollow cylinder rotor shaft rotatably supported by a cylinder rotor bearing provided by one of said fixed supports comprising said cylinder rotor support, each said housing cover can be spaced apart by plane contact with opposed ends of, and affixed to, a barrel, thereby substantially enclosing said cylinder rotor and said piston rotor within.

9. The device of claim 8, including:

each said housing cover is laterally extended to form essentially diametrically positioned ends and said piston rotor support means includes a pivot pin rotatably supported between said fixed supports, said pivot pin rotatably supporting a similar end of each said housing cover, the distal ends of each said housing cover attached to and supported by a displacement adjustment device and approximately midway the length of each said housing cover said hollow stub shaft is supported, each said hollow stub shaft sharing a common axis and each having a piston rotor bearing rotatably supporting each said disc-like member comprising said piston rotor.

10. The device of claim 1, wherein:

(a). said piston rotor is coupled for rotation with one end of a piston rotor shaft projecting from the center thereof, said piston rotor shaft rotatably supported for rotation of said piston rotor and said piston rotor shaft as a unit by at least one piston rotor bearing provided by said piston rotor support, and, (b). said cylinder rotor is coupled for rotation as a unit with said hollow cylinder rotor shaft, one end of said hollow cylinder rotor shaft protruding from the center thereof rotatably supported for rotation by at least one cylinder rotor bearing provided by said fixed support.

11. The device of claim 10, wherein:

a cylinder rotor support comprises a displacement adjustment arm having a pivot pin rotatably supporting one end of said arm, the distal end of said arm attached to and supported by a displacement adjustment device and approximately midway the length of said displacement adjustment arm at least one cylinder rotor bearing is provided rotatably supporting said cylinder rotor.

* * * * *